US005428687A

United States Patent [19]

Willcocks et al.

[11] Patent Number: 5,428,687

[45] Date of Patent: Jun. 27, 1995

[54] CONTROL VOLTAGE GENERATOR MULTIPLIER AND ONE-SHOT FOR INTEGRATED SURROUND SOUND PROCESSOR

[75] Inventors: Martin E. G. Willcocks, Taylorsville; James W. Fosgate, 4750 East 1200 South, Heber City, Utah 84032

[73] Assignee: James W. Fosgate, Heber City, Utah

[21] Appl. No.: 990,660

[22] Filed: Dec. 14, 1992

Related U.S. Application Data

[63] Continuation-in-part of Ser. No. 533,091, Jun. 8, 1990, Pat. No. 5,172,415.

[51] Int. Cl.[6] ..... H04S 5/02

[52] U.S. Cl. ..... 381/18; 381/22

[58] Field of Search ..... 381/22, 18; 307/517, 307/603, 381; 327/13, 14, 278, 283, 285

[56] References Cited

U.S. PATENT DOCUMENTS

| | | | |
|---|---|---|---|
| 3,281,534 | 10/1966 | Dersch | 307/517 |
| 3,710,023 | 1/1973 | Greuzard, Sr. et al. . | |
| 3,959,590 | 5/1976 | Scheiber . | |
| 3,969,588 | 7/1976 | Raydon et al. . | |
| 4,054,804 | 10/1977 | Tanaka | 307/603 |
| 4,932,059 | 6/1990 | Fosgate | 381/22 |
| 4,941,177 | 7/1990 | Mandell et al. | 381/22 |
| 4,953,213 | 8/1990 | Tasaki et al. . | |
| 5,027,687 | 7/1991 | Iwamatsu . | |
| 5,028,824 | 7/1991 | Young | 307/603 |
| 5,073,945 | 12/1991 | Kageyama et al. . | |
| 5,136,650 | 8/1992 | Griesinger . | |
| 5,263,087 | 11/1993 | Fosgate | 381/22 |

FOREIGN PATENT DOCUMENTS 79106741 8/1990 China .

OTHER PUBLICATIONS

Rashid, SPICE for Circuits and Electronics using PSpice, 1990, pp. 1–5, 101–119.

Millman and Halkias, Integrated Electronics, 1972, pp. 58–59.

Lancaster, "Envelope Generators & Sequencers for Electronic Music", Popular Electronics, Jan. 1976, pp. 58–62.

*Primary Examiner*—Forester W. Isen

*Attorney, Agent, or Firm*—David L. McCombs

[57] ABSTRACT

A surround sound processor for presentation of a stereophonic source program on a multiple loudspeaker array surrounding the listening area. The processor includes input signal conditioning and matrixing circuits, a control voltage generator responsive to the directional information contained in the stereophonic source signals, and a variable matrixing circuit for generating appropriate loudspeaker feed signals to create the illusion of the sound field wrapping around the listening area. The control voltage generator includes a servologic circuit employing variable time constant smoothing circuits each responsive to the difference signal between its input and its output and to a pulse signal from a one-shot triggered by threshold detectors which compare the difference signals with fixed threshold voltages. In one aspect, suitable for incorporation into an integrated circuit, a multiplier circuit and a controlled bidirectional current source charging and discharging a capacitor provides the smoothing function. Alternatively a symmetrical nonlinear resistive circuit or element is used to charge and discharge the capacitor. A novel and economical combined threshold detector and one-shot suitable for integrated circuits is also disclosed.

52 Claims, 10 Drawing Sheets

CONTROL VOLTAGE GENERATOR MULTIPLIER AND ONE-SHOT FOR INTEGRATED SURROUND SOUND PROCESSOR

CROSS REFERENCE TO RELATED APPLICATIONS

This application is a continuation-in-part of co-pending patent application Ser. No. 07/533,091, entitled "Surround Processor," filed Jun. 8, 1990, now U.S. Pat. No. 5,172,415, hereby incorporated by reference as if reproduced in its entirety.

TECHNICAL FIELD

The present invention relates in general to processors for the periphonic reproduction of sound. More particularly, the invention relates to alternative methods for varying smoothing time constants applied to directional information signals to provide control voltage signals, as generated within a control voltage generator circuit of a surround sound processor.

BACKGROUND OF THE INVENTION

A surround sound processor operates to enhance a two-channel stereophonic source signal so as to drive a multiplicity of loudspeakers arranged to surround the listener, in a manner to provide a high-definition soundfield directly comparable to discrete multitrack sources in perceived performance. An illusion of space may thus be created enabling the listener to experience the fullness, directional quality and aural dimension or "spaciousness" of the original sound environment. The foregoing so-called periphonic reproduction of sound can be distinguished from the operation of conventional soundfield processors which rely on digitally generated time delay of audio signals to simulate reverberation or "ambience" associated with live sound rooms. These conventional systems do not directionally localize sounds based on information from the original performance space and the resulting reverberation characteristics are noticeably artificial.

To accomplish this end, a surround sound processor typically comprises an input signal conditioning and matrix circuit, a control voltage generator circuit and a variable matrix circuit.

The input conditioning and matrix circuit usually provides for balance and level control of the input signals, generates normal and inverted polarity versions of the input signals, plus sum and difference signals derived therefrom, and in some cases generates phase-shifted versions thereof. Additionally, the signals may be filtered and split into multiple frequency ranges as needed by the remainder of the processing requirements.

The control voltage generator typically includes one or more band-pass filter circuits, directional detector circuits, and servologic circuits. The band-pass filter circuits weight the frequency response of the audio signals applied to the directional detector circuits so that these circuits respond similarly to the human ear. The directional detectors measure the correlations between the signals, which represent sounds encoded at different directions in the stereophonic sound stage, generating voltages corresponding to the directional location of the predominant sound. The servologic circuits use these signals to develop control voltage signals for varying the gains of voltage-controlled amplifiers in the variable matrix circuit in accordance with the original sound direction and the direction in which it is intended to reproduce the sound in the surrounding loudspeakers.

The variable matrix circuit includes a number of voltage-controlled amplifiers and a separation matrix. the voltage-controlled amplifiers amplify the audio signals from the input conditioning and matrix circuit with variable gain, which is controlled by the control voltage signals, and the resulting audio signals are applied to the separation matrix circuit where they are used to selectively cancel unwanted crosstalk in the different loudspeaker output signals. The separation matrix combines the outputs of the input conditioning and matrix with those of the voltage-controlled amplifiers in several different combinations, each resulting in a loudspeaker output signal intended for driving (through suitable power amplifiers) a loudspeaker positioned at a particular direction relative to the listener. In each of these loudspeaker output signals, certain unwanted crosstalk components may be dynamically eliminated by the action of the direction detector circuits, servologic circuits, voltage-controlled amplifiers, and separation matrix circuit.

In Fosgate's co-pending patent application Ser. No. 07/533,091, entitled "Surround Processor" a servologic circuit is disclosed. This circuit employs a smoothing filter with a variable time constant to smooth the directional information signal from each directional detector circuit, to produce a control voltage signal therefrom, each time constant being varied inversely with the absolute magnitude of the difference between the directional information signal and the corresponding control voltage signal. This is done by means of a width-modulated pulse train controlling a switch which selects between two resistors of different values, effectively varying the resistance according to the duty ratio of the width-modulated pulse train and changing the effective time constant with an associated capacitor in a continuous manner. Thus the modulating elements are placed within a negative feedback loop, providing a servo control system, whence is derived the term "servologic circuit."

In his co-pending application Ser. No. 07/789,530, Fosgate discloses the addition to this basic circuit of a one-shot circuit and threshold detector. The one-shot is designed to force the duty ratio of the width modulated pulse train to unity for a specific short period of time, causing all of the variable time constants to be reduced to their minimum values and thereby allowing the smoothed control voltage signals to catch up to their corresponding directional information signals rapidly, whenever the differences between them increase beyond the threshold level which triggers the one-shot. A one-shot was also disclosed in Fosgate's U.S. Pat. No. 4,932,059, this being triggered from a special attack detector circuit for sensing the rapid onset of new signals.

In the present invention, directed to circuitry suitable for inclusion in an integrated circuit for performing the servologic circuit functions, an alternative method of varying the time constants by means of a multiplier circuit is disclosed, and a novel circuit combining the functions of a threshold detector and one-shot is described. Furthermore, it is shown that the servologic circuit function can be effected by means of a nonlinear resistive network forming a variable time constant with a fixed capacitor.

The dynamic characteristics of the control voltage generator have a significant impact on the perceived quality of the spatial impression generated by a surround processor, and as the control voltage generator circuit is improved, the processor exhibits greater freedom from unwanted audible artifacts and improved dynamic separation.

SUMMARY OF THE INVENTION

It is an object of the invention to provide an improved surround processor for the reproduction of sound from a stereophonic source in a manner comparable to a live presentation from multiple sources in perceived performances.

It is another object of the present invention to provide a surround processor of the above type which provides faster but smoother and more realistic multichannel sound redistribution from a stereophonic source.

It is another object of the present invention to simplify and improve the circuitry previously used in the control voltage generator of a surround sound processor of the above type.

It is another object of the invention to provide circuitry suitable for implementation in an integrated circuit for the performance of the desired functions of a control voltage processor circuit.

In accordance with these and other objects, the present invention relates in particular to improvements in the implementation of the circuitry of a servologic control voltage generator, and the inclusion therein of a new multiplier circuit for varying the time constants in a servologic circuit instead of using a width-modulated high-frequency pulse train.

Furthermore, the present invention incorporates an improved and economical circuit combining the functions of a threshold detector and a one-shot.

Another aspect of the invention relates to the use of a nonlinear resistive network in a variable time constant circuit instead of a servologic circuit.

In a preferred embodiment the invention provides an audio signal processor for multichannel redistribution of stereophonic sound on a number of loudspeakers surrounding the listener, comprising an input conditioning and matrixing circuit, a variable matrixing circuit and a control voltage generator circuit for producing control voltages from the outputs of the input conditioning and matrixing circuit to control the parameters of the variable matrixing circuit.

The control voltage generator circuit of this embodiment includes input terminals for receiving at least one pair of partially correlated audio signals containing directional information from the input conditioning and matrixing circuit, at least one directional detector circuit for producing one or more directional information signals from these partially correlated audio signals, and at least one variable time constant smoothing circuit for smoothing each directional information signal to produce a corresponding control voltage signal, each such circuit being responsive to the difference between its input directional information signal and its output control voltage signal. The variable time constant smoothing circuit comprises a variable current source driving a capacitor, across which the control voltage is developed, the current source charging and discharging the capacitor with a current controlled by a current control circuit which is acted upon by the difference signal between the input directional information signal and the output control voltage signal, this difference signal being generated by a differencing amplifier circuit. The charging and discharging current may be proportional to the cube or the square of the difference signal when it is small, while becoming linearly proportional to it when it is larger. This can be achieved by the use of a novel triple multiplier circuit suitable for incorporation into integrated circuitry.

An advantage of this arrangement is that no high frequency switching transients exist which might potentially cause crosstalk and instability problems in an integrated circuit incorporating the servologic circuit.

Further, the control voltage generated across the capacitor may be buffered and inverted to provide a second control voltage signal. An advantage of this is that the buffered and inverted signals simplify controlling of the parameters of the variable matrixing circuit.

Alternatively, the variable current may be produced by impressing the difference voltage across a voltage-dependent resistive network, to produce a similar variation in current to that stated above. An advantage provided by this method is circuit simplicity.

In addition, the control voltage generator may include a threshold detector and one-shot triggered thereby of novel and economical design suitable for integrated circuitry, this circuit forcing the equivalent time constant of each of the variable time constant smoothing circuits to its minimum value for the duration of the one-shot output pulse, to ensure rapid correction of the control voltages when any of the directional information signals changes rapidly to a new value, without perceptible intermodulation distortion occurring.

BRIEF DESCRIPTION OF THE DRAWINGS

The novel features believed characteristic of the present invention are set forth in the appended claims. The invention itself, as well as other features and advantages thereof, will best be understood by reference to the following detailed description of an illustrative embodiment when read in conjunction with the accompanying figures, wherein:

FIG. 9*a* is a block schematic illustrating the use of a nonlinear resistance element with a capacitor to simulate the servologic circuit of FIG. 6;

FIGS. 9*b*–9*d* are detailed schematics of nonlinear resistive networks for use in the circuit of FIG. 9*a.

DETAILED DESCRIPTION OF THE INVENTION

Figure 1:
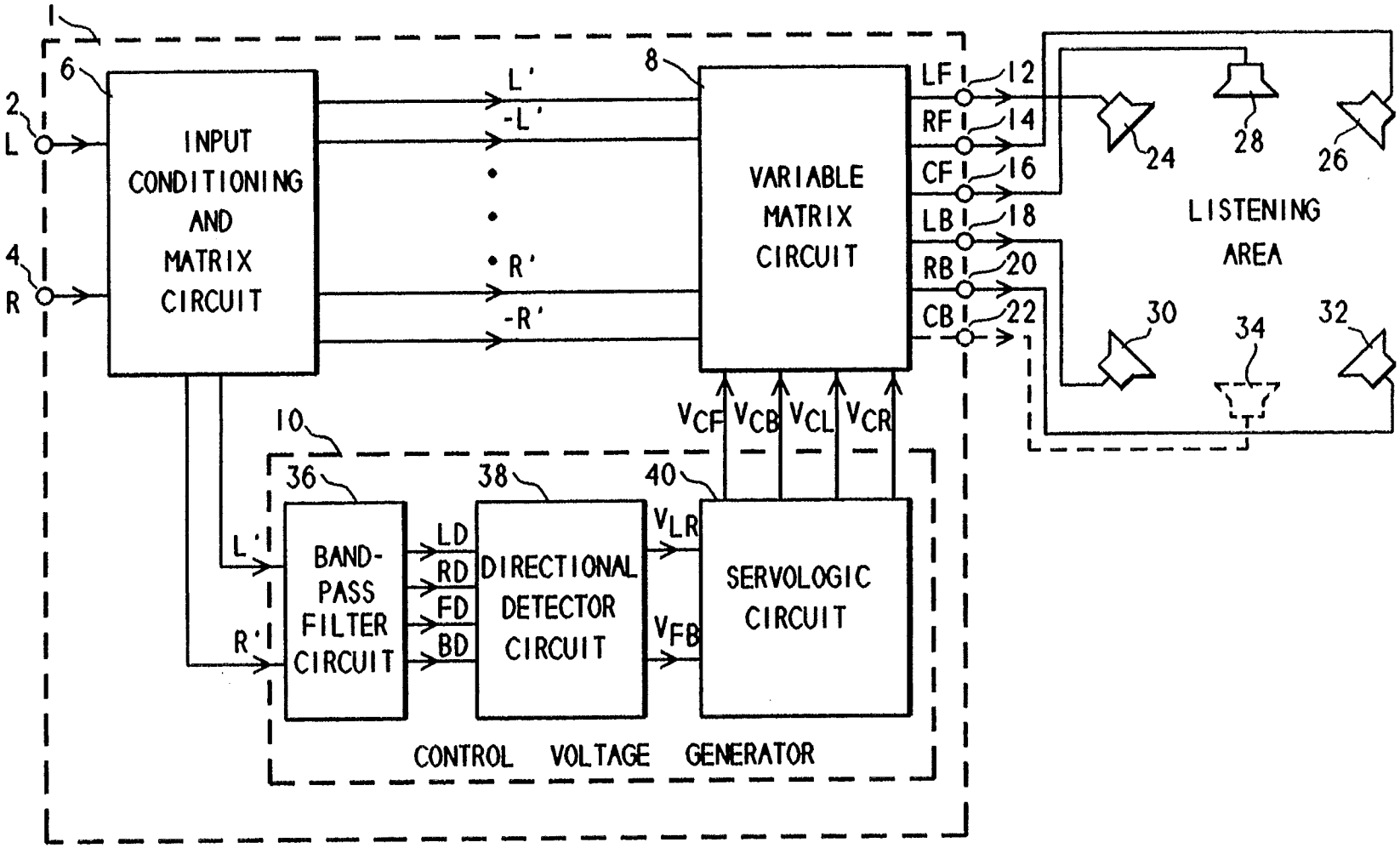
FIG. 1 is a block diagram which illustrates a surround sound processor involving the present invention.

Referring to FIG. 1, which illustrates the block schematic of a surround sound processor 1, a pair of audio input signals labeled L and R for left and right channel signals from a stereophonic source are respectively applied to input terminals 2 and 4 of the processor 1.

An input conditioning and matrix circuit 6 receives these signals and processes them for application to subsequent circuitry. This input matrix circuit 6 may contain user-adjustable level and balance controls for providing correctly balanced signals at an appropriate level for driving the remaining circuitry, automatic balancing circuitry for maintaining correctly balanced signals, a user-variable panorama control circuit for varying the effective width of surround sound presentation of the sounds being reproduced, and matrixing circuitry for providing suitable combinations of the conditioned input signals, these combinations being referred to as combination audio signals, to the variable matrixing circuit 8 and servologic control voltage generator circuit 10. The combination audio signals produced by this circuit are labeled L', −L, R' and −R', and in practice additional combination audio signals may be provided, represented by the elision dots between the lines labeled −L' and R'.

The variable matrixing circuit 8 combines the combination audio signals received from the input conditioning and matrix circuit 6 in fixed and varying proportions to provide a set of output signals labeled LF, RF, CF, LB, RB and optionally CB at corresponding terminals 12–22 for application via suitable power amplification (not shown) to a set of loudspeakers 24–34 arranged around a listening area substantially as shown, so as to provide the desired effect of sound surrounding the listeners. Loudspeaker 34 and the connections to it via terminal 22 may be omitted in some systems, as indicated by rendering these elements in broken lines. Although not shown in FIG. 1, outputs may also be provided for left and right side loudspeakers, and for subwoofers at various locations.

The varying proportions of the combination audio signals produced by input conditioning and matrix circuit 6 used in variable matrixing circuit 8 are determined by several control voltage signals labeled $V_{CF}$, $V_{CB}$, $V_{CL}$, and $V_{CR}$, which are provided by the servologic control voltage generator circuit 10 in response to input signals thereto labeled L' and R', produced by input conditioning and matrix circuit 6. The effect of combining the combination audio signals in such varying proportions is to cancel out unwanted signals from each of the output signals of the processor 1 so as to provide each loudspeaker 24–34 with appropriate signals corresponding to the direction of that loudspeaker relative to the listening area, to create the impression of a sound field expanded to surround the listener. The degree of such expansion may be altered by the listener as desired, by use of the panorama control mentioned previously as an optional component of input conditioning and matrix circuit 6.

The control voltage generator 10 comprises three sections of circuitry; a band-pass filter circuit 36, a directional detector circuit 38 and a servologic circuit 40. The signals L' and R' from the input conditioning and matrix circuit 6 are filtered by the band-pass filter circuit 36 and are also combined therein to produce four current signals labeled LD, RD, FD and BD. The band-pass filter circuit 36 has been described in detail in copending application Ser. No. 07/789,529 with reference to FIG. 2 of that application. No further description of this band-pass filter circuit will be given here, as the present invention does not involve any changes or alternative circuitry to that shown therein.

The current signals LD, RD, FD, and BD are applied to the directional detector circuit 38 where they are compared to produce a pair of directional information signals labeled $V_{LR}$ and $V_{FB}$. The directional detector circuit comprises a pair of log-ratio detectors, which compare the LD and RD signals to produce the directional information signal $V_{LR}$, and similarly compare the FD and BD signals to produce the directional information signal $V_{FB}$. The servologic circuit 40 acts to smooth these signals $V_{LR}$ and $V_{FB}$ with variable time constants, and to generate from them four control voltage signals labeled $V_{CF}$, $V_{CB}$, $V_{CL}$, and $V_{CR}$, which are applied to the variable matrix circuit 8.

Figure 2:
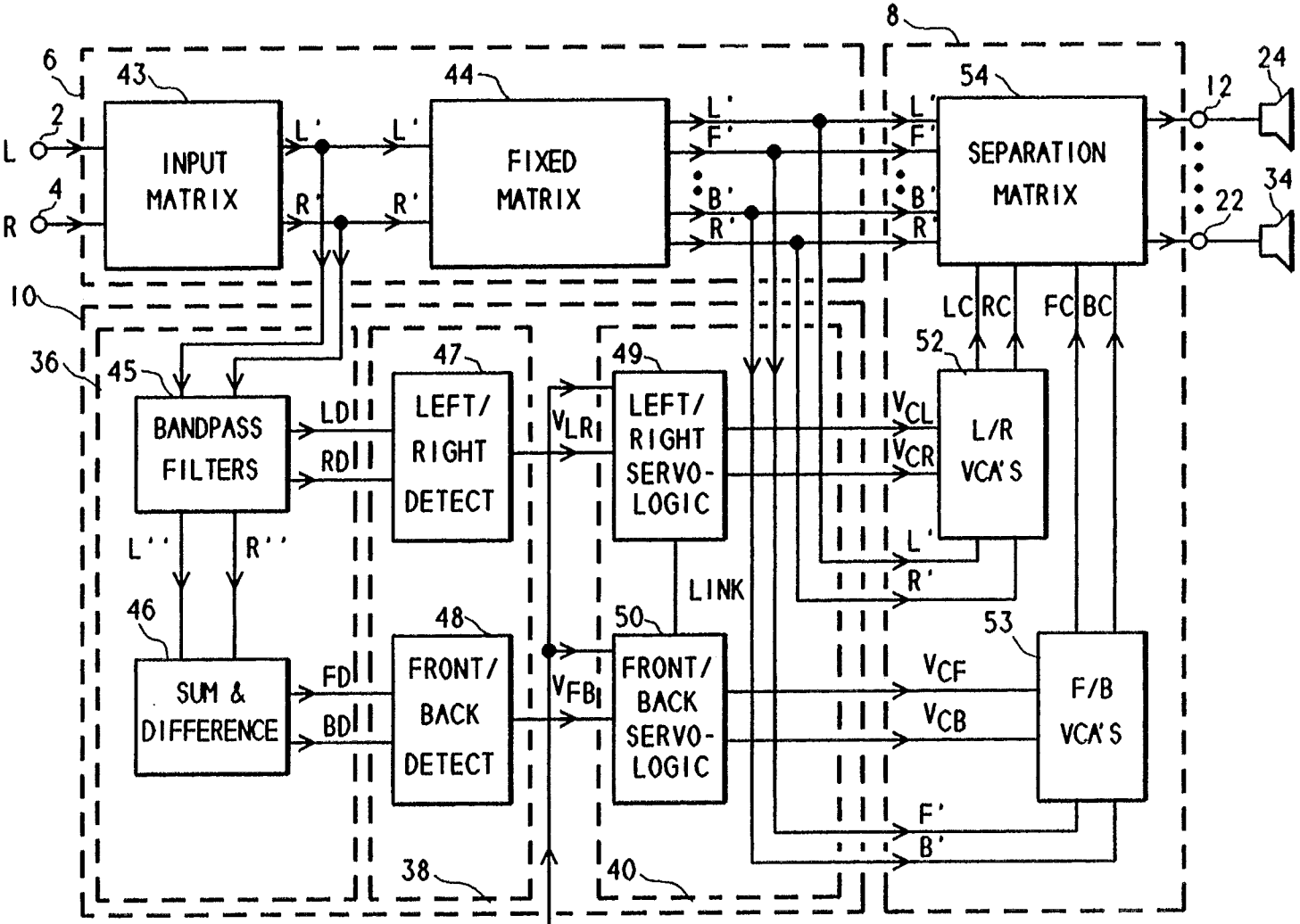
FIG. 2 is a block diagram illustrating the processor of FIG. 1 in more detail.

Referring to FIG. 2, which illustrates a more detailed block schematic of the circuit of FIG. 1, it will be seen that the input conditioning and matrix circuit 6 comprises an input conditioning circuit labeled 43 and a fixed matrix circuit labeled 44. As described previously, the input conditioning circuit 43 combines the audio input signals L and R applied to its input terminals 2 and 4 by means of an optional panorama control, amplifies them to suitable maximum levels for application to following circuits, and balances them manually and/or automatically for the optimum sound reproduction to be achieved. These conditioned signals are labeled L' and R' to distinguish them from the unmodified audio input signals L and R.

The signals L' and R' are matrixed in the fixed matrix circuit 44 to provide at least the combination audio signals L', R', F' and B' to following circuitry to be described below. In addition, the inverted versions of these signals, −L', −R', −F', and −B', may be generated in circuit block 43. The possibility of these additional signals is depicted by elision dots between signal lines labeled F' and B'. The signals F' and B' are respectively the sum L'+R' and difference L'−R' of the signals L' and R', which are also passed unchanged by the circuitry of block 44.

The signals L' and R' from input conditioning circuit 6 are also connected to the inputs of the control voltage generator 10, which comprises the bandpass filter circuit 36, directional detector circuit 38 and servologic circuit 40. The first stage of the bandpass filter circuit 36 is bandpass filters circuit block 45, where the L' and R' signals are filtered with a frequency response approximating an inverse of the relationship between human aural sensitivity and frequency at the threshold of audibility, so as to make the action of the directional detector circuit 38 correspond more closely to the sensitivity characteristics of the human ear, as described in copending applications Ser. Nos. 07/533,091 and 07/789,529. The output signals are labeled L'' and R'' to distinguish them from the full bandwidth signals L' and R'. The final stages of these filters 45 convert the signals L'' and R'' from the bandpass circuits into current signals labeled LD and RD, via an additional pole of high-pass filtering.

The filtered signals L'' and R'' from the bandpass filter 45 are summed and differenced in sum and difference circuit 46 to produce internal sum and difference signals (not indicated), which are passed through an additional pole of high-pass filtering to produce current signals labeled FD and BD. This additional pole of filtering matches that used for the LD and RD signals.

The bandpass-filtered current signals LD, RD, FD and BD are applied to the directional detector circuit 38, comprising identical left/right detector 47 and front/back detector 48. The detectors 47 and 48 produce directional information signals $V_{LR}$ and $V_{FB}$ respectively.

These signals are in turn applied to the servologic circuit 40 which again comprises two identical circuits 49 and 50, labeled left/right servologic and front/back servologic respectively. A linkage between these circuits may be provided to force both circuits to respond quickly when sudden changes in directional information are sensed by either circuit. Additionally, although not shown, some elements of the circuitry may be shared by both of the servologic circuits 49 and 50.

The servologic circuits 49 and 50 may optionally be switched to a different mode of operation required for reproduction according to the Dolby Laboratories Ltd. Pro-logic system by means of a signal applied to terminal 51 provided for mode selection. In this mode of operation, two different smoothing time constants are selected depending upon the absolute magnitudes of the directional information signals $V_{FB}$ and $V_{LR}$.

Each of these servologic circuits 49, 50, provides a pair of output signals which are the control voltage signals mentioned previously. The left/right servologic circuit 49 generates control voltage signals $V_{CL}$ and $V_{CR}$ from the directional information signals $V_{LR}$, while the front/back servologic system 50 generates the control voltages $V_{CF}$ and $V_{CB}$ from the directional information signal $V_{FB}$.

The signals L', R', F' and B' and their inverted forms from the fixed matrix circuit 44 are applied to the inputs of the variable matrixing circuit 8. As described in copending application Ser. No. 07/533,091, this circuit comprises a set of voltage controlled amplifiers (VCA's) and a number of summing amplifiers commensurate with the number of loudspeakers to be used for reproduction of the sound.

The VCA's are shown in two pairs, represented by the circuit blocks 52, labeled L/R VCA's, and 53, labeled F/B VCA's. The L/R VCA's 52 actually comprise a left VCA controlled by the control voltage signal $V_{CL}$, with an input signal L', and a right VCA controlled by the control voltage signal $V_{CR}$, with an input signal R'. Similarly, the F/B VCA's 53 comprise a front VCA controlled by the control voltage signal $V_{CF}$ for variably amplifying the input signal F' derived in the fixed matrix circuit 44, and a back VCA controlled by the control voltage signal $V_{CB}$ to amplify the signal B' from the fixed matrix circuit 44.

The output signals from the left, right, front and back VCA's respectively are labeled LC, RC, FC and BC, and are the cancellation audio signals which are applied to the separation matrix circuit 54 forming part of the variable matrix circuit 8. The combination audio signals L', R', F' and B', and their inverses, −L', −R', −F,' and −B', are also applied to this separation matrix circuit 54. Each of the summing amplifiers making up the separation matrix circuit 54 combines fixed proportions of these combination audio signals with appropriate proportions of the cancellation audio signals, which are variably amplified or attenuated versions of the combination audio signals −L', −R', −F' and −B', as the VCA's are typically in an inverting configuration.

When a predominantly left channel signal is presented to the inputs 2, 4 of the surround sound processor 1, for example, the left/right servologic circuit 49 produces a control signal $V_{CL}$ of maximum value, causing the left VCA in circuit block 52 to have its maximum gain, while the other three control voltages are zero, and the gains of the other three VCA's are also zero. The cancellation audio signal LC is made equal to −L', and is applied to cancel out the L' signals in summing amplifiers of circuit block 54 for all loudspeaker output audio signals other than left front (LF) and left back (LB) (see FIG. 1), so that the resultant sound appears to the listener to come from the left side of the listening area. The cancellation audio signal LC may also be added into the LF and LB output audio signals to maintain the correct overall sound pressure level in the listening area, which might otherwise be reduced by the cancellations occurring in the other loudspeakers. Furthermore, the relative levels of LF and LB output audio signals may depend upon the optional panorama control position and upon the particular levels of augmentation of these signals as selected by the user through switchable mode options (not shown) for a wide or narrow surround sound spreading effect.

Similar considerations apply when any of the other three control voltage signals reach their maximum values, forcing the sound field generated to conform with the desired surround sound effect.

When signals containing predominant sound directions other than the principal directions of precisely left, right, front or back, are applied to the surround sound processor 1, two of the four control voltage signals assume values less than their maximum values, causing the effective cancellation of the sound from loudspeakers generally opposite to or flanking the intended localization, while maximizing the output of loudspeakers generally in the direction of the intended localization for the predominant sound. This ensures that the listener will receive an impression of the sound apparently coming from the intended direction.

While most surround sound processors of the variable matrixing type perform similar operations on the signals and achieve high separation of predominant signals when the predominant direction varies only slowly, more typically the predominant signals change from instant to instant, causing the control voltage signals to vary in accordance with the changes of predominant sound direction. Consequently, for realistic sound reproduction, it is necessary for the dynamic variations of directional information content of the audio input signals to be tracked and followed closely by the servologic control voltage generator, yet without imposing artifacts on the surround sound presentation. Such artifacts are often present and have been described as "breathing", "warbling" and other forms of instability of the sound image, and transient intermodulation distortion effects.

Figure 3:
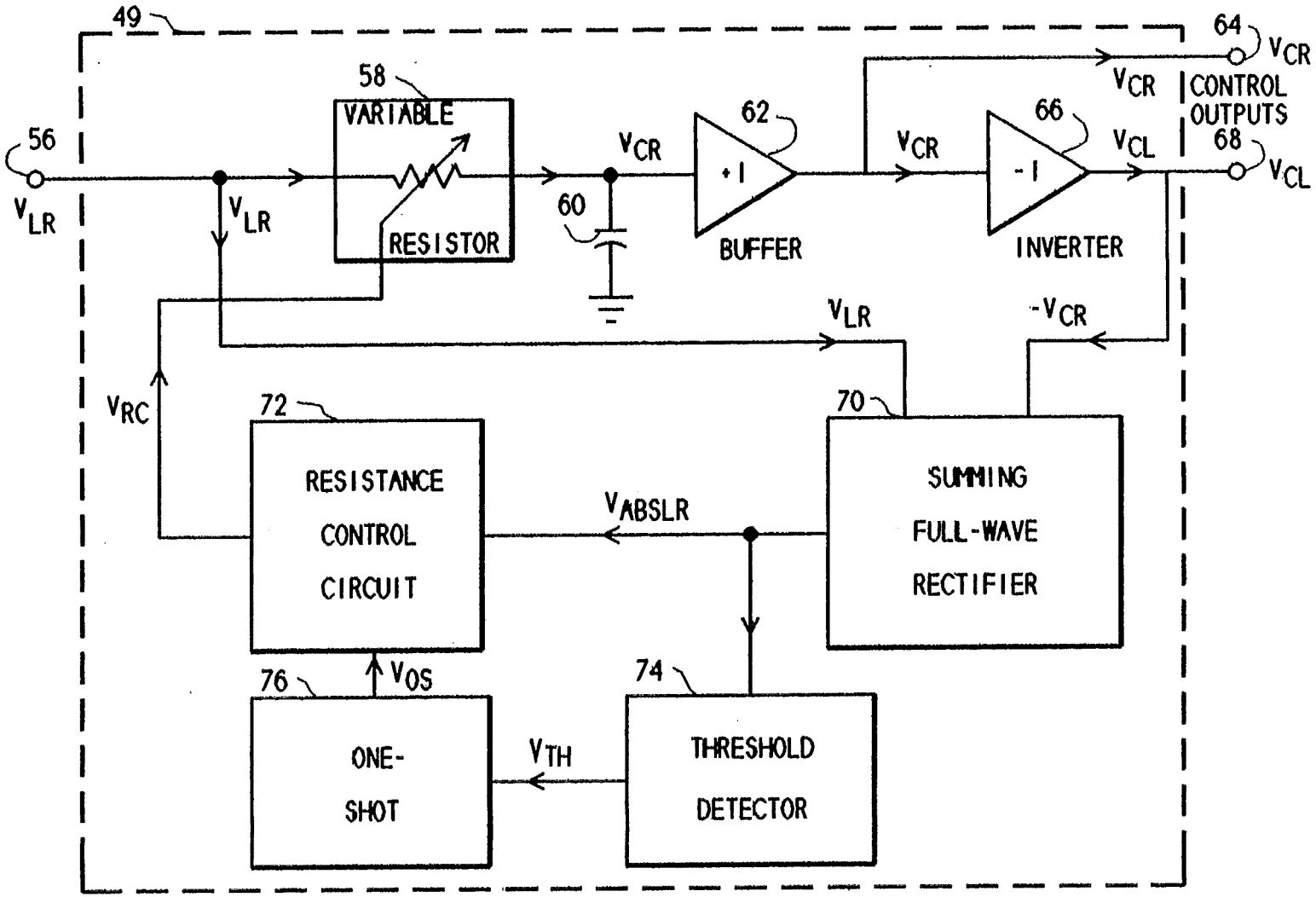
FIG. 3 is a block schematic of a servologic circuit of a control voltage generator of the processor of FIG. 1, according to co-pending application Ser. No. 07/789,530.

Referring to FIG. 3, which illustrates a block schematic of a servologic circuit 49 according to the copending applications Ser. Nos. 07/533,091 and 07/789,529, which is one of the two identical circuits comprising block 40 of FIG. 2, a directional information signal $V_{LR}$ is applied to input terminal 56. This signal passes through a variable resistance element 58 to a shunt capacitor 60 with which variable resistance element 58 forms a variable time constant smoothing filter.

The smoothed signal appearing on capacitor 60 is buffered by a unity gain buffer 62 and provided at one output terminal 64 as the control voltage signal $V_{CR}$. This buffered control voltage signal is then applied to a unity gain inverter 66 and the inverted control voltage signal $V_{CL}$ from inverter 66 is provided to following circuitry through a second output terminal 68.

The input directional information signal $V_{LR}$ and the output inverted control voltage signal $V_{CL}$ are both applied to a summing full-wave rectifier circuit 70, which combines them in equal proportions and rectifies the resulting signal to provide an absolute value signal $V_{ABSLR}$ at its output. Since the sum of the input signals is also the difference between the input signal $V_{LR}$ and the smoothed control voltage signal $V_{CR}$, it represents the absolute value of the voltage appearing across the variable resistance element 58.

The absolute value signal $V_{ABSLR}$ is applied to a resistance control circuit 72 which generates a resistance control signal $V_{RC}$ for controlling the resistance of variable resistance element 58, to which this signal is applied. The sense of this control is such that when the absolute value signal increases in magnitude, the resistance of element 58 is reduced, thereby shortening the time constant of the smoothing filter comprising elements 58 and 60. This permits the voltage $V_{CR}$ appearing on the capacitor 60 to more rapidly approach the input voltage $V_{LR}$ applied to terminal 56. Thus the difference is reduced, causing the absolute value signal $V_{ABSLR}$ to decrease and allowing the variable time constant to again increase as the control voltage signal $V_{CR}$ catches up with the directional information signal $V_{LR}$.

These elements of the servologic circuit 49 are discussed in Fosgate's co-pending application Ser. No. 07/533,091. In his co-pending application Ser. No. 07/789,530, Fosgate details the additional elements 74 and 76, which are respectively a threshold detector and a one-shot.

The absolute value signal $V_{ABSLR}$ is also applied to the input of the threshold detector circuit 74, which compares it with a fixed threshold voltage derived internally. When the absolute value signal exceeds this threshold voltage, the circuit generates an output signal labeled $V_{TH}$ which is applied to the one-shot 76 and triggers it to produce an output pulse signal $V_{OS}$, which in turn is applied to the resistance control circuit 72. This signal causes the resistance control circuit to deliver its maximum possible output signal to the variable resistance element 58 so as to force the variable time constant to its minimum value for the duration of the pulse. The output pulse signal $V_{OS}$ is of a specific short duration, sufficiently long to ensure that the control voltage signal $V_{CR}$ catches up to the directional information signal $V_{LR}$ almost completely, yet sufficiently short that intermodulation distortion between the control signals $V_{CR}$ and $V_{CL}$ and the combination audio signals applied the VCA's of circuit block 52 of FIG. 2 is not audible or offensive to the listener. This duration has been found to be between 15 ms and 20 ms in most cases, with the minimum time constant formed by elements 58 and 60 being set to about 3 ms.

It has been found useful to employ two threshold detector circuits, one for each of servologic circuits 49 and 50 of FIG. 2, with a single one-shot circuit 76, whose output pulse signal $V_{OS}$ is applied to both resistance control circuits 72, thereby forcing both sets of control voltages to catch up with their respective directional information signals simultaneously.

In the co-pending applications Ser. Nos. 07/533,091 and 07/789,530 previously referred to, the variable resistance element 58 has been implemented as a pair of unequal resistors with a controlled switch element, such that when the switch is on, the resistance is greatly reduced. Typically, the minimum resistance has been 30 kΩ and the maximum resistance 470 kΩ, with a capacitance of 0.1 μF for capacitor 60, thereby providing a minimum time constant of 3 ms and a maximum time constant of 47 ms.

Also, the resistance control circuit has been implemented in the form of a width-modulated pulse oscillator, the duty ratio of which is proportional to the absolute value signal $V_{ABSLR}$ applied to it. The output pulse train therefore switches the variable resistance element 58 rapidly (at an ultrasonic frequency) between its low and high resistance states, causing its average resistance to lie between the minimum and maximum values possible. Thus the average smoothing time constant has been made continuously variable and responsive to the absolute value signal $V_{ABSLR}$ in the manner desired.

Figure 4:
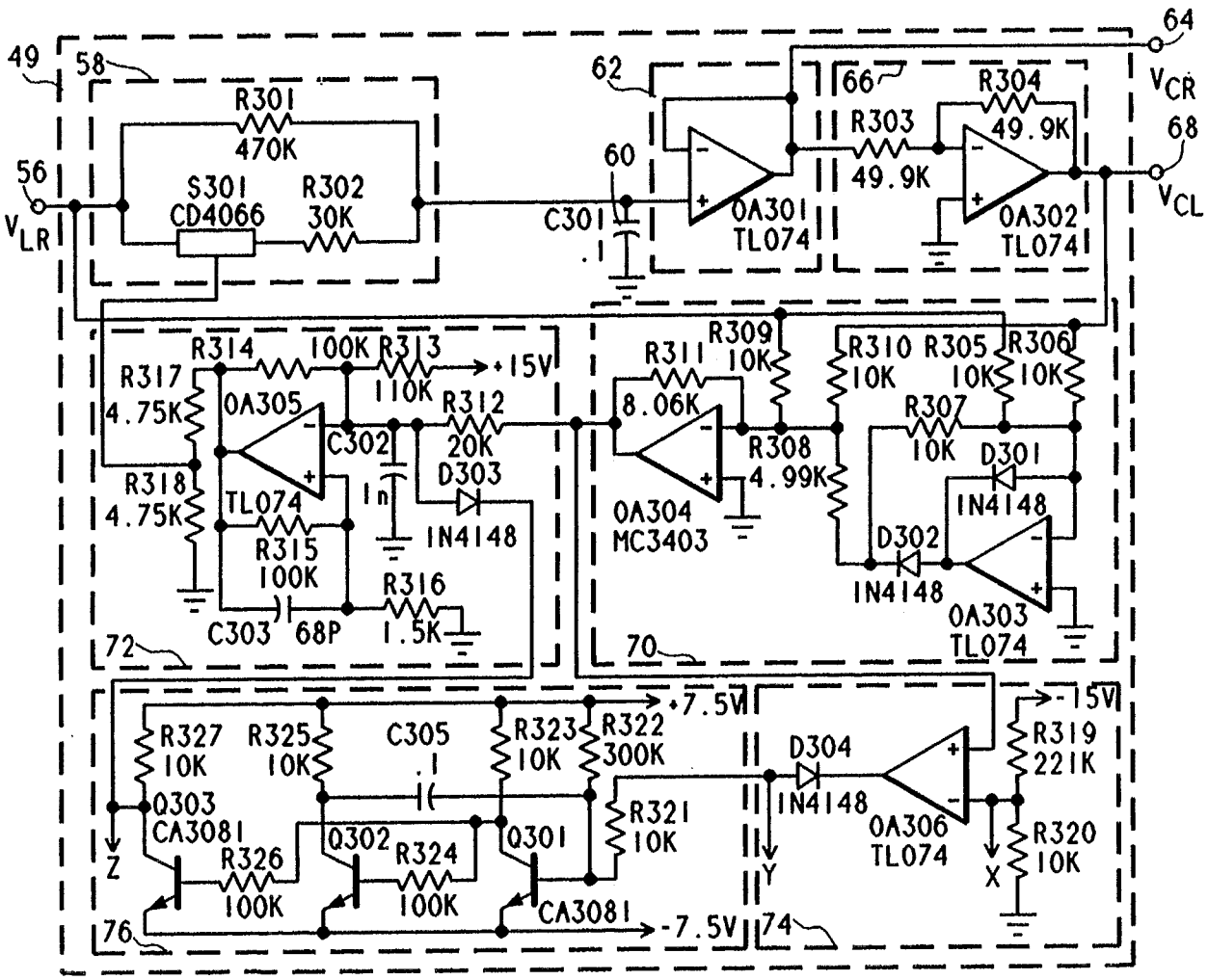
FIG. 4 is a detailed schematic of a servologic circuit of the control voltage generator of FIG. 3.

Turning now to FIG. 4, which illustrates an embodiment of this servologic circuit according to co-pending application Ser. No. 07/789,529 and is shown therein as FIG. 7, the various circuit elements of servologic circuit 49 are shown in detail. The signal $V_{LR}$ is applied to terminal 56 and thence to the variable resistor element 58. This comprises a CMOS switch element S301, in conjunction with fixed resistors R301 and R302. Although shown with a resistor R301 in parallel with a series combination of switch S301 and resistor R302, alternatively resistor R301 may be in parallel with the switch S301 only, and resistor R302 in series with this combination, without altering the function of this circuit block.

Following this variable resistor element 58, a capacitor C301 is identified with capacitor 60 of FIG. 3. The voltage thereon is buffered by a source follower operational amplifier OA301 which forms unity gain buffer 62, and an inverter 66 comprising operational amplifier OA302 with resistors R303 and R304 to define a gain of unity. The outputs of buffer 62 and inverter 66 are available at terminals 64 and 68 respectively, to provide the control voltage signals $V_{CR}$ and $V_{CL}$ to following circuitry.

The summing full-wave rectifier circuit 70 comprises operational amplifiers OA303 and 0A304 with associated resistors R306–R311 and diodes D301 and D302, in a conventional circuit, producing a negative-going absolute value signal proportional to the difference between the signals $V_{LR}$ and $V_{CR}$. The gain is defined by resistor R311, and the output is limited to ±6 V approximately by supplying operational amplifier OA304 from reduced supply voltages (not shown.)

The absolute difference signal $V_{ABSLR}$ is applied to the resistor control circuit 72, which is a pulse oscillator formed by operational amplifier OA305 and its associated resistors R312–R318 and capacitors C302 and C303. This oscillates with a duty cycle that increases as the absolute difference signal applied to resistor R312 goes negative, reaching a duty cycle of 1 when this voltage goes below about −5 V. The output pulses from this circuit 72 are attenuated by resistors R317 and R318 to an appropriate level to drive the CMOS switch S301 in variable resistor element 58. When the duty cycle is zero, switch S301 is off, and the time constant due to R301 and C301 is about 47 ms. When the duty cycle is 1, the switch S301 is continuously on, and the time constant is reduced to a minimum value of about 2.8 ms due to the parallel combination of resistors R301 and R302 with capacitor C301.

The lower part of FIG. 4 shows the threshold detector 74 which comprises operational amplifier OA306 with biasing resistors R319 and R320 to set the threshold voltage (which is also applied to the same point of the threshold detector of the second servologic circuit 50, not shown, through the line labeled X.) The output of the threshold detector is applied through diode D304 to the one-shot 76. A similar diode in the threshold detector of the second servologic circuit 50 is connected to point Y to effect triggering of the same one-shot 76 when the other threshold detector operates.

The one-shot 76 comprises transistors Q301-Q303 with capacitor C304 and resistors R321-R327. Its output pulse width is defined by resistor R322 with capacitor C304, and the pulse is applied via diode D303 to the resistor control circuit 72, forcing the voltage on capacitor C702 negative to drive the duty cycle to 1 for the duration of the pulse. The resistor control circuit of the second servologic circuit 50 of FIG. 2 is driven from point Z through a similar diode included therein.

Thus the circuit of FIG. 4 implements the operational requirements of a servologic circuit according to the block schematic of FIG. 3.

In order to provide circuitry with an equivalent function but suitable for implementation as a bipolar integrated circuit, the present invention proposes two alternative approaches which are discussed below with reference to FIGS. 5–7.

It was believed undesirable for high voltages at high frequencies to be present in the integrated circuit, and consequently an alternative method of controlling the effective time constant was needed. Referring to FIG. 5, and by comparison with FIG. 3, three elements were changed in the new circuit. There is now no direct connection between the input terminal 56 and the capacitor 60, which formerly occurred through variable resistance element 58. Instead, a variable current source element 98 drives a current ICS into or out of capacitor 60. If this current is made equal to that which would have been flowing in the variable resistance element 58 at all times, the resulting waveform on capacitor 60 would be identical to that in the circuit of FIG. 3.

Instead of the summing full-wave rectifier 70 of FIG. 3, a summing amplifier 100 is used to generate a voltage $V_{DIFLR}$, which represents the difference between the input directional information signal $V_{LR}$ and the voltage appearing on the capacitor 60, but in this circuit the absolute value of the difference voltage is not needed. This difference signal $V_{DIFLR}$ is applied to a current control circuit 102 which varies the current $I_{CS}$ of the variable current source 98 in accordance with the current control signal $V_{CSC}$ derived from the difference signal.

The threshold detector 74 differs in details from that of FIG. 3, in that it now has to sense when the magnitude of the difference signal $V_{DIFLR}$ exceeds either a positive or a negative threshold voltage, and to trigger the one-shot 76 whenever either threshold is exceeded. Detailed circuitry of such a threshold detector and one-shot is described below with reference to FIG. 10.

Figures 9A, 9B, 9C, 9D:
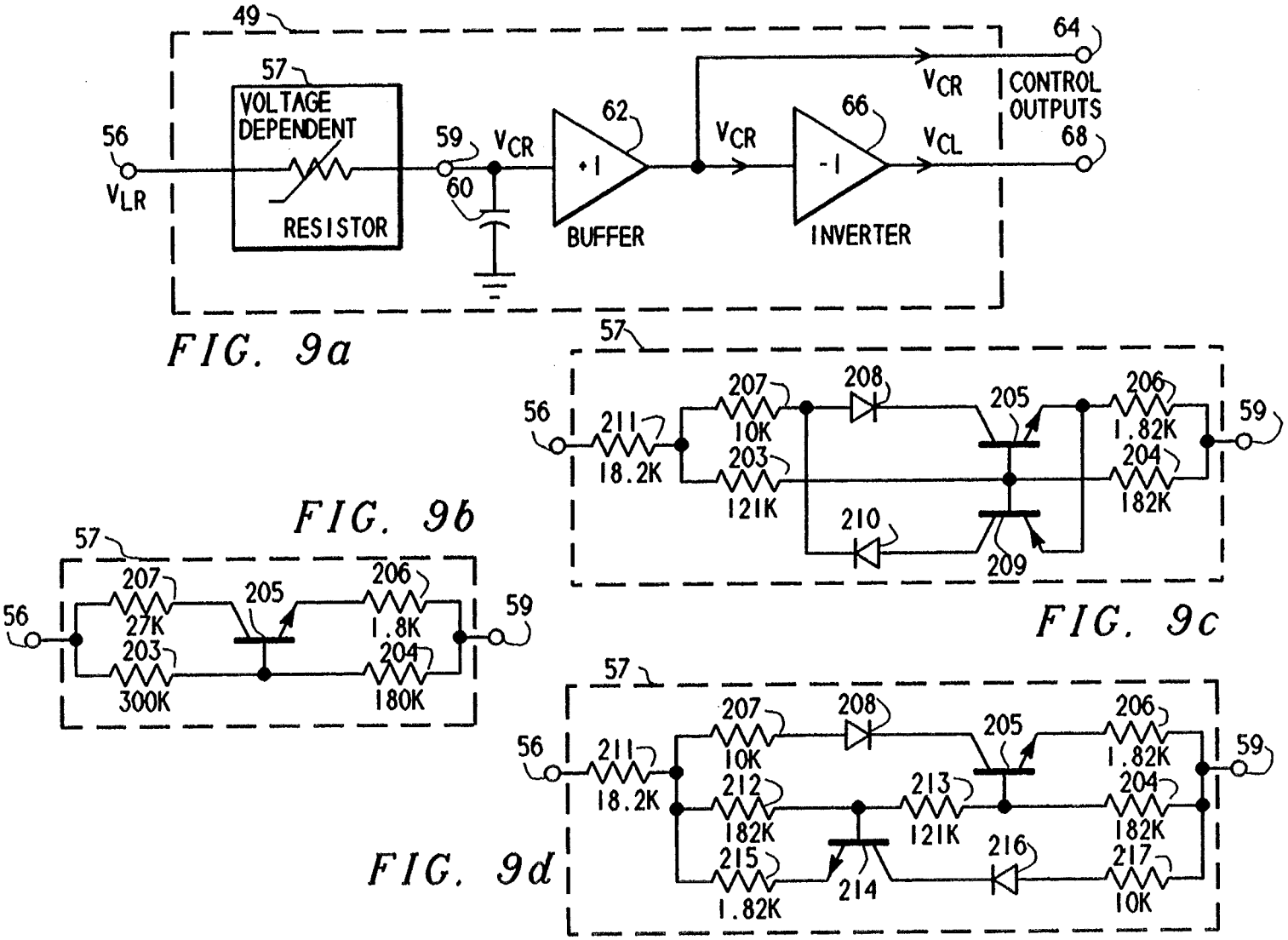

Several different kinds of circuit can be used to control the current source 98. In a first embodiment, not shown here, a nonlinear resistance element similar to those shown and described later with reference to FIGS. 9*b*–9*d* is used. By impressing the voltage $V_{DIFLR}$ across this element, a current having the desired characteristics is generated, and a bidirectional current mirror circuit similar to that described below with reference to FIG. 7 is used to represent the current source 98, mirroring this current into the capacitor 60. As this approach has drawbacks in integrated circuit form, it was not considered further for this requirement.

In the pulse width modulation type of circuit of FIG. 3, it can be shown that the conductance of the variable resistance element 58 varies proportionally to the duty ratio of the pulse oscillation, which in turn is directly proportional to the absolute value signal $V_{ABSLR}$, so that the current through the variable resistance element 58 varies as the square of this absolute value signal, but with the same polarity as the actual difference between its input and output voltages $V_{LR}$ and $V_{CR}$ respectively. When the duty ratio reaches unity, however, there is no further change in its conductance, and thereafter the current varies linearly with the applied absolute value signal.

Therefore, a second possible approach suggested for the integrated circuitry was to use a log-antilog squaring circuit to generate a current proportional to the square of the input voltage, and having the same polarity. Using a bidirectional current mirror circuit, this current would be forced into the capacitor 60. However, this approach proved to require more PNP transistors than the multiplier circuit to be discussed below with reference to FIG. 7. On a semi-custom chip, this would present a problem, since the number of available PNP devices is limited. Even in a custom IC design, the squaring circuit is not truly complementary when implemented with two circuits of identical topology but using complementary transistor types.

It was possible, based on available transistors on a semi-custom BiFET chip, to implement on a single chip a complete directional detector circuit and a servologic circuit. However, after prototyping the device, it was found that while the proposed circuitry worked, the IC had insufficient vias to allow proper power supply voltage distribution, which problem could be solved only by going to a full-custom design.

Figure 6:
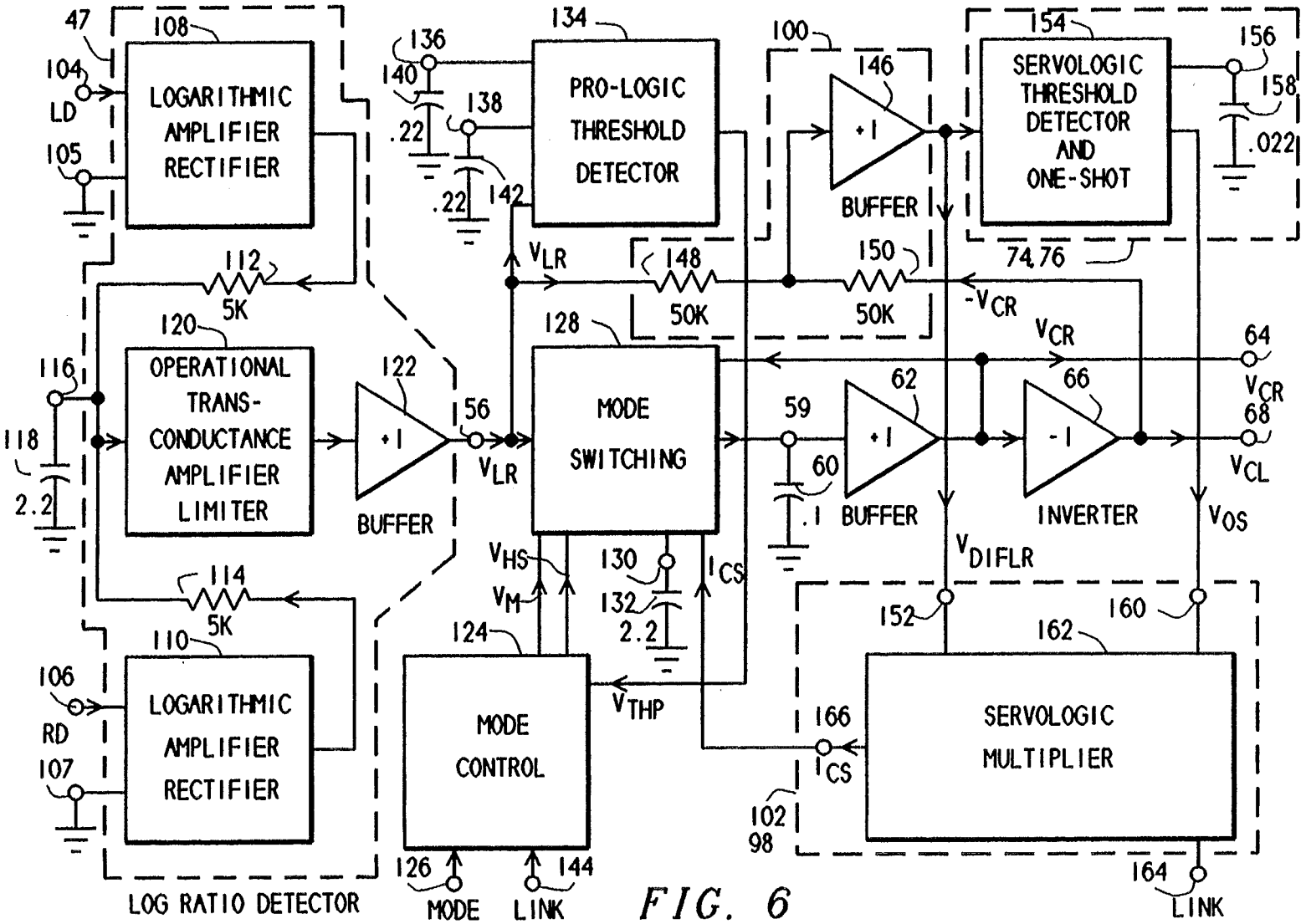
FIG. 6 is a block schematic of an integrated circuit comprising a direction detector circuit and a servologic circuit of a control voltage generator of the processor of FIG. 1, according to the present invention.

The block schematic of an integrated circuit for implementing the directional detector circuit 47 and servologic circuit 49 is shown in FIG. 6. The servologic circuit 49 comprises all the elements to the right of the directional detector block in dashed outline labeled 47, but for clarity and to avoid cluttering the drawing these elements have not been drawn inside an additional dashed outline and labeled 49.

In this circuit, the directional detector circuit 47 comprises two logarithmic amplifier rectifier circuits, 108 and 110, an operational transconductance amplifier 120 and a buffer 122. These circuit blocks serve to generate from the input signals LD and RD applied to input terminal 104 and 106, with respect to ground terminals 105 and 107, a directional information Signal $V_{LR}$, which appears at terminal 56. Although the detailed circuitry of these elements is not disclosed in this application, the logarithmic amplifier rectifier circuits 108 and 110 produce output signals by amplifying their input signals using a logarithmic amplifier, following which an inverter and a full-wave rectifier generate d.c.

voltages corresponding to the logarithms of the amplitudes of the two signals, one positive and the other negative. These signals are applied through resistors 112 and 114 and terminal 116 to an external smoothing capacitor 118. The resultant signal is amplified and limited by the operational transconductance amplifier 120 and buffered by a unity gain buffer 122 whose output is connected through terminal 56 to the rest of the circuitry. The signal $V_{LR}$ at terminal 56 is therefore proportional to the difference between the logarithms of the amplitudes of the LD and RD current input signals, and therefore to the logarithm of their ratio, hence the term "log-ratio detector" for this type of circuit. Other suitable log-ratio detector circuits have been fully disclosed by Fosgate in co-pending application Ser. No. 07/533,091.

The integrated circuit was required to operate in both a servologic mode and a Dolby Pro-Logic mode, and therefore includes circuitry for mode selection and mode switching, as well as circuitry specific to the Pro-Logic mode.

The mode control circuit 124 receives a MODE selection voltage at terminal 126 for determining whether the servologic or Pro-Logic mode is selected. The mode-switching circuit 128 is designed to switch between fixed internal resistors using the external capacitor 132 connected to terminal 130 when in Pro-Logic mode, and the output of the servologic multiplier circuit 162 when in servologic mode.

In the Pro-Logic mode, a threshold detector circuit 134 is used to determine when the input directional information signal $V_{LR}$ exceeds either a positive or a negative threshold voltage generated therein, and terminals 136 and 138 are used to connect external capacitors 140 and 142 respectively to provide the desired time constants in this circuit.

A link terminal 144 connects the threshold detectors in two identical chips in a wired-OR manner via the mode control circuit 124, so that either threshold detector can operate on both of a pair of integrated circuits to select between low and high speed time constants when the circuit is in the Pro-Logic mode. This linkage and time constant selection is ineffective when the circuit is in servologic mode. Because these elements of FIG. 6 are only used in the Pro-Logic mode, they will not be discussed further here, as they are licensed proprietary features of that system, due to Mandell et al., and are not the subject matter of the present invention.

In the servologic mode, the effective components are the servologic multiplier 162, the summing amplifier 100 formed by buffer 146 with resistors 148 and 150, and the combined servologic threshold detector and one-shot 154, along with the adjacent components. The capacitor 60, buffer 62, and inverter 66 are used in both servologic and Pro-logic modes. The servologic multiplier combines the functions of the current control circuit 102 and the variable current source 98 of FIG. 5, and is therefore labeled with both numerals.

To understand the functioning of this circuit, the directional detector circuit 47 produces a directional information signal $V_{LR}$ from its input current signals LD and RD. This signal, appearing at terminal 56, is applied to resistor 148 directly (the other connections shown are not relevant to the servologic mode.) The voltage appearing on the capacitor 60 is buffered by unity gain buffer 62 and appears as the control voltage signal $V_{CR}$ at terminal 64. It is also fed back to the mode switching block 128 to act as a reference voltage within that circuitry. This voltage is then inverted by unity gain inverter 66 and appears as a second control voltage signal $V_{CL}$ at terminal 68. It is also applied to resistor 150 as the negative of $V_{CR}$.

The voltage appearing at the junction of resistors 148 and 150 is therefore the average of the directional information signal $V_{LR}$ and control voltage signal $V_{CL}$, and is equal to one half of the difference voltage between terminals 56 and 59. This voltage is buffered by the unity gain buffer 146 to provide the difference signal $V_{DIFLR}$ to the servologic multiplier 162 at terminal 152. It is also applied to the input of the servologic threshold detector and one-shot circuit 154.

The servologic multiplier 162 produces an output current $I_{CS}$ at terminal 166, which is returned through the mode-switching circuit 128 to terminal 59 and thence to capacitor 60, completing the negative feedback loop.

Figure 5:
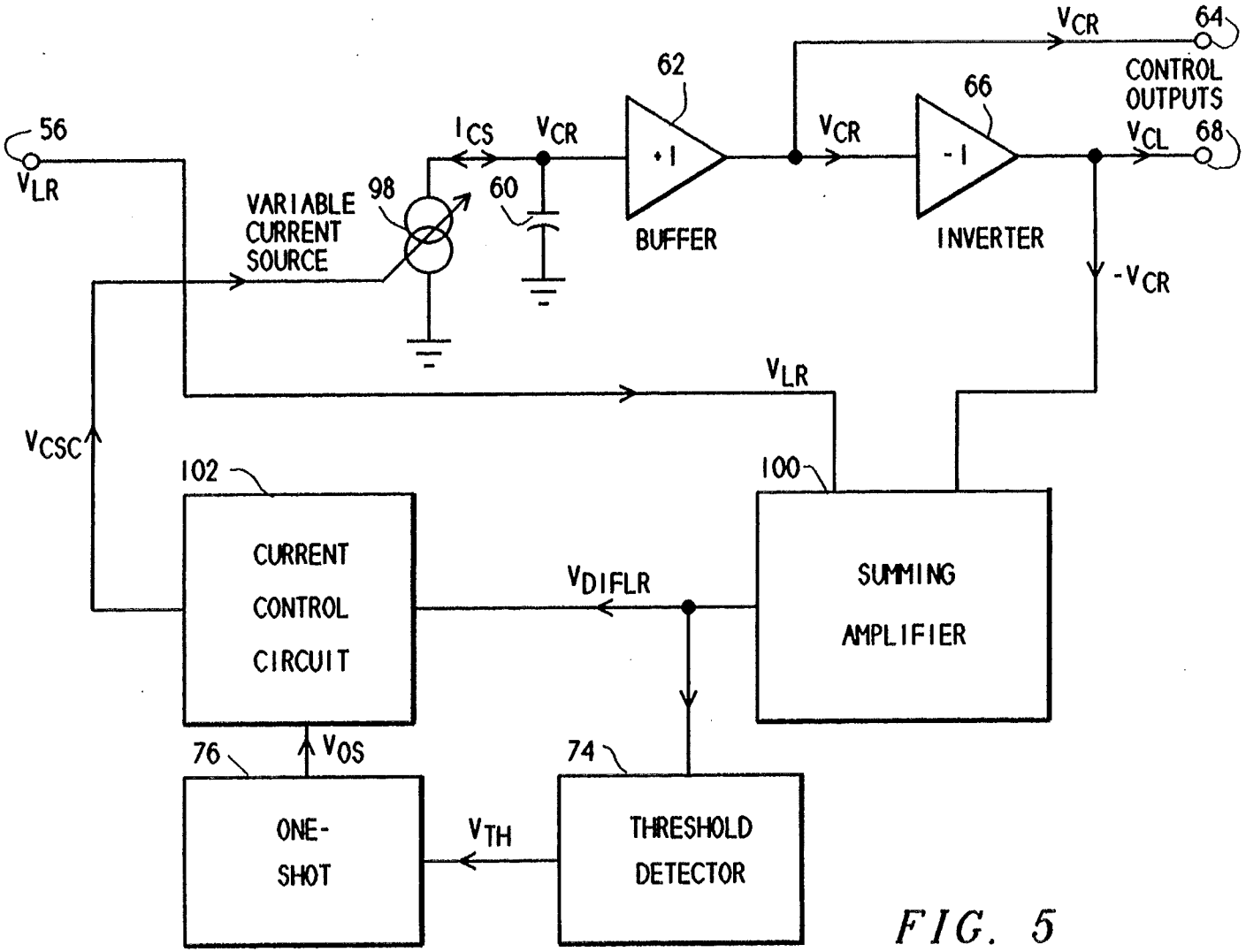
FIG. 5 is a block schematic of a servologic circuit according to the present invention.

The threshold detector and one-shot circuit 154 combines the functions of threshold detector 74 and one-shot 76 of FIG. 5, and is therefore labeled with both these numerals. The duration of the pulses produced by the one-shot 76 is determined by the timing capacitor 158 connected to the integrated circuit via terminal 156. An output signal $V_{OS}$ is connected via terminal 160 to the servologic multiplier 162, acting on this circuit to make the current $I_{CS}$ directly proportional to the difference signal $V_{DIFLR}$ with a mutual conductance equivalent to a resistor of about 30 kΩ, so that the effective time constant is about 3 ms while the one-shot pulse continues. When two servologic circuits are connected, a link terminal 164 is connected to the same terminal of the second servologic circuit, so that when either of the one-shot circuits 76 is triggered, both multipliers 162 are switched to their minimum effective time constants.

Figure 7:
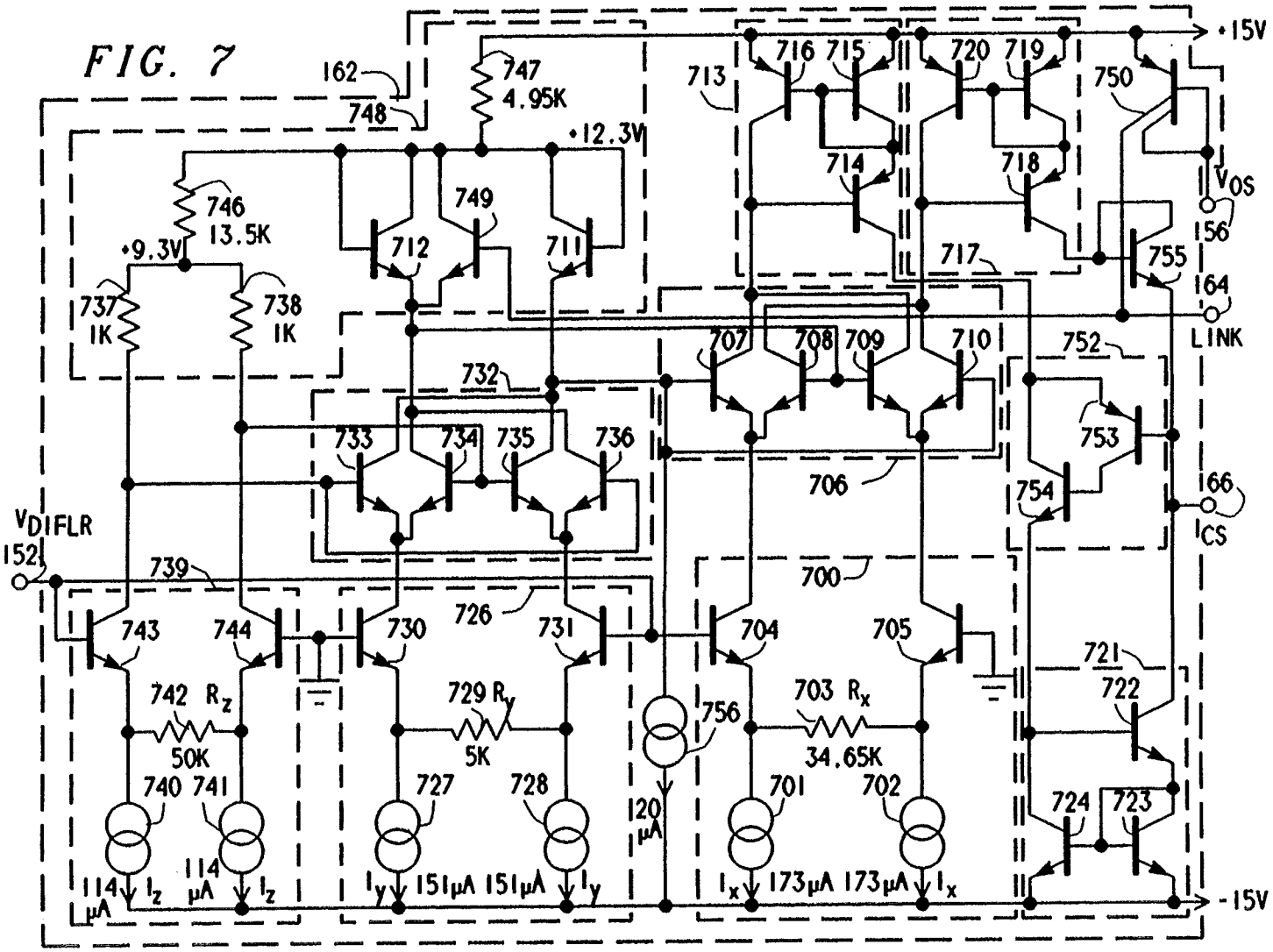
FIG. 7 is a detailed schematic of a multiplier circuit for use in the servologic circuit of FIG. 6.

The detailed circuitry of the servologic multiplier 162 is shown in FIG. 7. This comprises an X-input circuit labeled 700, a Y-input circuit labeled 726, a Z-input circuit labeled 739, a multiplier cell 706, a second multiplier cell 732, a load circuit 748, two PNP current mirror circuits 713 and 717, an NPN current mirror circuit 721, a compound PNP transistor 752, and transistors 750 and 755.

The difference signal $V_{DIFLR}$ is applied to terminal 152, and thence to the base of transistor 704 in the X-input circuit block labeled 700. A matched transistor 705 has its base grounded, and transistors 704 and 705 are supplied with equal currents by current sinks 701 and 702 respectively. A resistor 703, also labeled $R_x$, is connected between the emitters of transistors 704 and 705. Those skilled in the art will recognize this circuit 700 as a voltage-to-current converter of a type often used in Gilbert multiplier circuits. When $V_{DIFLR}$ goes positive, the current flowing in transistor 704 is increased by an amount $V_{DIFLR}/R_x$, and that in transistor 705 is decreased by the same amount. When $V_{DIFLR}$ exceeds the product of $R_x$ with the current $I_x$ provided by each of the current sinks 701 and 702, transistor 705 is cut off, and no further increase in collector current of transistor 704 can occur. This happens with an input voltage $V_{DIFLR}$ of approximately +6 V, since $I_x$ is 173 μA and $R_x$ is 34.65 kΩ, their product being 5.994 V.

The first multiplier cell 706 comprises matched transistors 707–710, connected as two long-tailed pairs. The bases of transistors 707 and 710 are connected together and to the emitter of transistor 711 of the load circuit 748. The bases of transistors 708 and 709 are similarly connected to the emitter of transistor 712 of load circuit 748. Transistors 711 and 712 are also closely matched, and are diode-connected, their bases and collectors being returned to a fixed supply voltage of +12.3 V in this circuit.

The collectors of transistors 707 and 709 are connected to the base of transistor 714 in the first PNP current mirror circuit 713, and the collectors of transistors 708 and 710 are connected to the base of transistor 718 in the second identical PNP current mirror circuit 717. The bases of transistors 714 and 718 are typically held at about +13.5 V, so that transistors 707–710 are never saturated.

The collector currents of transistors 704 and 705 are split by transistors 707–710 into pairs of currents in a ratio which depends upon the currents flowing in transistors 711 and 712, and recombined for outputting to the current mirrors a pair of currents containing a product term between the signal applied to the input of X-input circuit 700 and the differential current signal applied to transistors 711 and 712, which we shall see later to be derived from the input difference signal $V_{DIFLR}$ also. Again, this multiplier cell and transistors 711 and 712 are standard features of a Gilbert multiplier circuit.

In the quiescent condition, the currents flowing from the current mirrors 713 and 717 are equal. The current mirrors 713 and 717 are of the Wilson type, comprising three matched lateral PNP devices in a configuration which almost eliminates current errors due to the low current gain ($\beta$ or $h_{FE}$) of typical lateral PNP transistors. Therefore, the current flowing out of transistor 714 is almost identical to that flowing into transistors 707 and 709, and the current flowing out of transistor 718 is almost identical to that flowing in transistors 708 and 710.

The current out of transistor 714 passes through a compound PNP transistor 752, comprising transistors 753 and 754, which has an effective current gain of several thousand times, so that only a very small current is lost to the base of transistor 753. Thus the emitter current of transistor 754 is almost the same as the collector current of transistor 714. This current is used to drive an NPN current mirror circuit 721 comprising matched NPN transistors 722–724 again in a Wilson configuration. The collector current of transistor 722 therefore accurately matches that from the emitter of transistor 754.

It will be seen that the collector current of transistor 718 passes through a diode-connected NPN transistor 755 to the collector of transistor 722, and to the current output terminal 166. This point is also connected to the base of transistor 753 of the compound PNP device 752, which draws a negligibly small base current. Since the currents in transistors 714 and 718 are matched, there is no net current flowing via terminal 166 to the capacitor 60 of FIG. 6, apart from extremely small offsets due to the finite current gains of the transistors and slight differences in transistor geometries.

The current mirror circuits 713, 717, and 721 with the devices 752 and 755, form a bidirectional current mirror circuit having a differential current input and a single-ended output at terminal 166.

The input difference signal $V_{DIFLR}$ is also applied to the base of transistor 731 in the Y-input circuit 726, and to the base of transistor 743 in the Z-input circuit 739. In the circuit 726, the current sinks 727 and 728 draw equal currents $I_y$ of about 151 $\mu$A through transistors 730 and 731, whose emitters are connected via resistor 729 which has a value of 5 kΩ in this circuit. The circuit 726 functions similarly to circuit 700, except that it limits at a voltage of about 755 mV in this case.

The collectors of transistors 730 and 731 are connected to the emitters of transistors 733–736 in the second multiplier cell 732. The bases of transistors 733 and 736 are connected to resistor 737 of the load circuit 748. The bases of transistors 734 and 735 are connected to resistor 738. The other ends of resistors 737 and 738 are taken to a common supply voltage at about 9.3 V. The collectors of transistors 733 and 735 connect to the emitter of transistor 711 and the collectors of transistors 734 and 736 connect to the emitter of transistor 712.

In the Z-input cell 739, equal sink currents are drawn through transistors 734 and 744 by current sinks 740 and 741. The emitters of transistors 743 and 744 are connected through resistor 742, labeled $R_z$, whose value is typically 50 kΩ. The voltage $V_{DIFLR}$ applied to the base of transistor 743 causes its current to increase and therefore to make its collector voltage negative with respect to that of transistor 744. There is a voltage attenuation in this stage, due to the low value of resistors 737 and 738, which is 1 kΩ. However, the multiplier cell 732 responds to very small voltages and effectively limits at between 120 mV to 180 mV difference between their base voltages. This corresponds to an input voltage of about 3 V to 4.5 V. As an alternative, resistors 737 and 738 could be replaced by diode-connected transistors like 711 and 712 and the value of $R_z$ changed to a suitable lower value, about 27 kΩ.

Since the sum of the currents in transistors 743 and 744 is constant, the voltage drop across resistor 746 in the load circuit 748 is constant and is about 3 V. Similarly, the sum of the currents through transistors 730 and 731 is constant, and therefore so is the sum of the currents through transistors 711 and 712. Thus the volt drop across resistor 747 is constant and is about 2.7 V. These voltage drops are used to derive the internal supply voltages at 12.3 V and +9.3 V within the load circuit 748.

We now define what happens in this multiplier circuit as the voltage $V_{DIFLR}$ changes. Let the currents in the resistors $R_x$, $R_y$ and $R_z$ be $xI_x$, $yI_y$, and $zI_z$, respectively, where x, y, and z each vary between −1 and 1 as $V_{DIFLR}$ varies through its range of −6 V to +6 V. We can show that $$x = V_{DIFLR}/(I_x R_x) \quad (1)$$

$$y = V_{DIFLR}/(I_y R_y) \quad (2)$$

$$z = V_{DIFLR}/(I_z R_z) \quad (3)$$

and the currents in transistors 704, 705,731,730, 743 and 744 respectively are $I_x(1+x)$, $I_x(1-x)$, $I_y(1+y)$, $I_y(1-y)$, $I_z(1+z)$ and $I_z(1-z)$.

For the Z-input cell, the difference voltage applied to transistors 733–736 is $2zI_z \times 1$ kΩ. For a pair of transistors with a tail current I and a base voltage difference of V, the emitter currents are in a ratio which is determined by the basic diode equation $$V = (kT/q)\,(\ln(I_1/I_s) - \ln(I_2/I_s)) \quad (4)$$

$$= (kT/q)\ln(I_1/I_2) \quad (5)$$

where k is Boltzmann's constant, T is the absolute temperature, q is the electronic charge, $I_1$ is the current in the first transistor of the pair, $I_2$ is the current in the second transistor and $I_s$ is the saturation current of the transistors (typically about 10 fA.) The value of (kT/q) is about 26 mV at room temperature. The total current, $$I=I_1+I_2 \quad (6)$$

so that $$I_1=I(1+z)/2 \quad (7)$$

$$I_2=I(1-z)/2 \quad (8)$$

and hence $$V=(kT/q)\ln[(1+z)/(1-z)] \quad (9)$$

$$=2(kT/q)\tanh^{-1} z \quad (10)$$

With this direct relationship between the interbase voltage of the pair and the value z, we can find the inverse relationship $$z=\tan h(Vq/2\,kT) \quad (11)$$

For the Z-input stage, 739, the interbase voltage $V_z$ is given by $$V_z=0.04\,V_{DIFLR} \quad (12)$$

because the stage is a linear amplifier. We can readily work out the value of z for different input voltages. However, for small inputs, the value of z varies essentially linearly with $V_z$, limiting to $\pm 1$ for large values of $V_z$. The polarity of $V_z$ is that which makes the bases of transistors 734 and 735 more positive than those of transistors 733 and 736 when $V_{DIFLR}$ is positive.

The Y-input stage 726 produces currents $I_{731}$ and $I_{730}$ in transistors 731 and 730 respectively, where $$I_{731}=I_y(1+y) \quad (13)$$

$$I_{730}=I_y(1-y) \quad (14)$$

The currents in transistors 733, 734, 735, and 736, are therefore:

$$I_{733}=I_{730}(1-z)/2=I_y(1-y)(1-z)/2 \quad (15)$$

$$I_{734}=I_y(1-y)(1+z)/2 \quad (16)$$

$$I_{735}=I_y(1+y)(1+z)/2 \quad (17)$$

$$I_{736}=I_y(1+y)(1-z)/2 \quad (18)$$

and combining these yields the currents in transistors 711 and 712:

$$I_{711}=I_y[(1+y)(1+z)+(1-y)(1-z)]/2 \quad (19)$$

$$I_{712}=I_y[(1-y)(1+z)+(1+y)(1-z)]/2 \quad (20)$$

and simplifying and grouping terms yields:

$$I_{711}=I_y(1+yz) \quad (21)$$

$$I_{712}=I_y(1-yz) \quad (22)$$

These currents flowing in the diode-connected transistors 711 and 712 cause a differential voltage between their emitters, which is applied to the bases of the transistors 707–710 of the multiplier cell 706. This voltage is given by $$V_{yz}=2(kT/q)\tan h^{-1}yz \quad (23)$$

and is always in the same polarity, because y and z go positive and negative together. Thus the emitter voltage of transistor 711 is always equal to or lower than that at the emitter of transistor 712.

The currents in transistors 704 and 705 are given by:

$$I_{704}=I_x(1+x) \quad (24)$$

$$I_{705}=I_x(1-x) \quad (25)$$

and they are split by the transistors in multiplier cell 706 into four currents:

$$I_{707}=I_{704}(1-yz)/2=I_x(1+x)(1-yz)/2 \quad (26)$$

$$I_{708}=I_x(1+x)(1+yz)/2 \quad (27)$$

$$I_{709}=I_x(1-x)(1+yz)/2 \quad (28)$$

$$I_{710}=I_x(1-x)(1-yz)/2 \quad (29)$$

Combining these yields the currents flowing from current mirrors 713 and 717 as:

$$I_{713}=I_x[(1+x)(1-yz)+(1-x)(1+yz)]/2 \quad (30)$$

$$I_{717}=I_x[(1-x)(1-yz)+(1+x)(1+yz)]/2 \quad (31)$$

and simplifying and grouping terms yields:

$$I_{713}=I_y(1-xyz) \quad (32)$$

$$I_{717}=I_y(1+xyz) \quad (33)$$

and thus the multiplier forms a triple product term. Since the currents in mirrors 713 and 717 are balanced against each other by current mirror circuit 721, the output current $I_{CS}$ flowing into terminal 166 and thence via the mode switch circuit 128 to terminal 59 and capacitor 60 is given by:

$$I_{CS}=2xyz\,I_y \quad (34)$$

Figure 8:
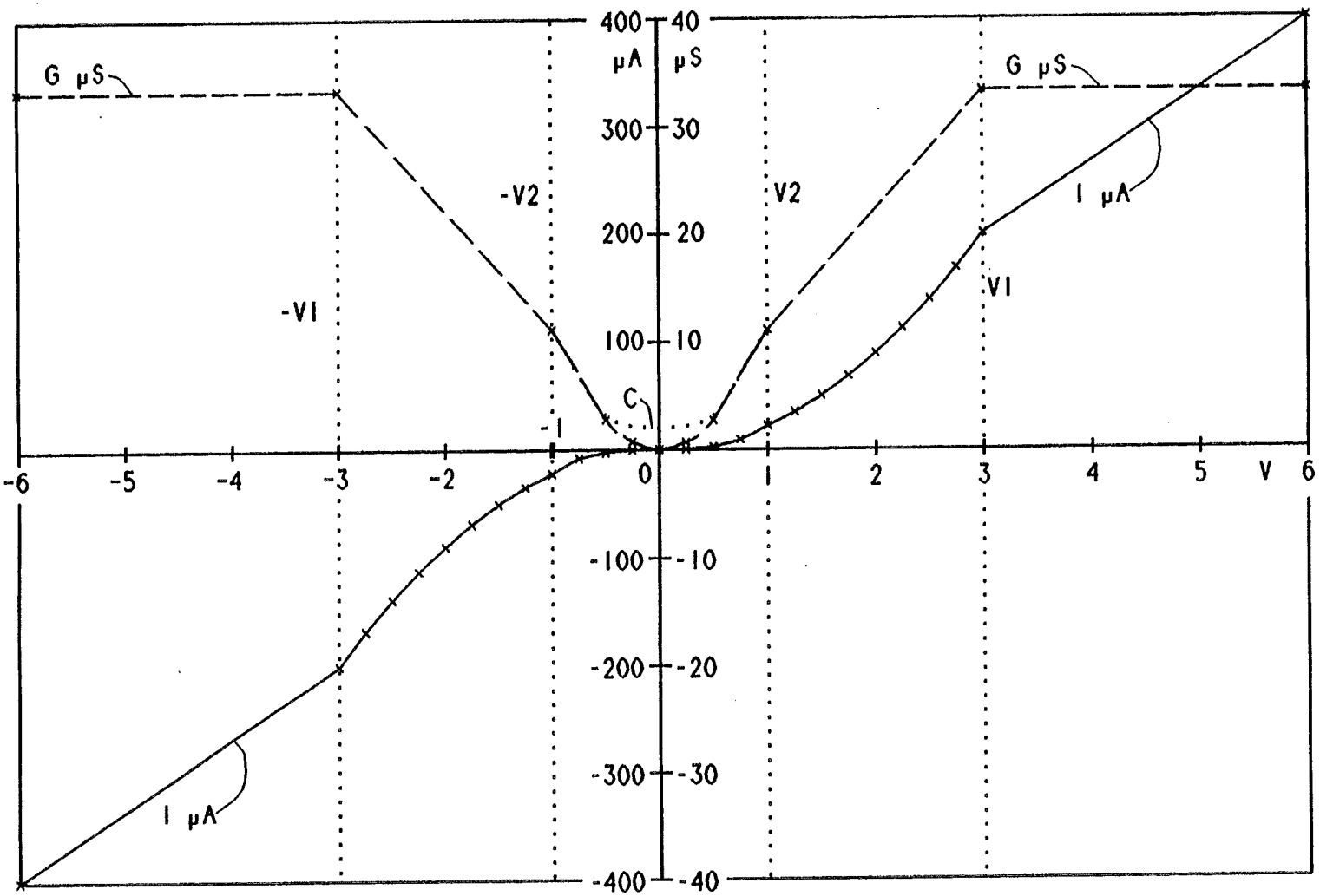
FIG. 8 is a diagram illustrating the performance characteristics of the multiplier circuit of FIG. 7 of the present invention.

Since the three multiplier stages limit at different input voltages, in the active region of all three multipliers (input voltages less than 750 mV), the circuit provides an output current proportional to the cube of the input voltage; when the Y-input stage limits, the output current is proportional to the square of the input voltage, and when the Z-input stage limits, the output current is proportional to the input voltage. These characteristics are shown in the graph of FIG. 8, In FIG. 7, there are three remaining components, transistors 750 and 749, and current sink 756. Transistor 750 receives a current output from the one-shot circuit to be described later with reference to FIG. 10, which produces a voltage $V_{OS}$ at its base. Most of this current flows in the right-hand collector of transistor 750. As it is a dual-collector lateral PNP transistor, an equal current flows in the left-hand collector, into the base of transistor 749, so that this transistor pulls the emitter voltage of transistor 712 positive, to just below the voltage at its collector. This shuts off the transistor 712, and produces a large interbase voltage for the multiplier cell 706, forcing the effective value of the product yz to 1. The output current of the multiplier is thus changed to 2 $xI_x$. This is equivalent to the current that would flow into the capacitor 60 if the resistor $R_x$ were placed directly between the terminals 56 and 59 of FIG. 6.

The current sink 756 slightly unbalances the voltage applied to the bases of multiplier transistors 707–710, in such manner as to reduce the voltage at the emitter of transistor 711 below that at the emitter of transistor 712 by a few millivolts. This has the effect of making the product yz never fall to exactly zero. Therefore, the multiplier behaves as if a large value resistor were connected between terminals 56 and 59 when the difference signal $V_{DIFLR}$ is zero.

Finally, we come to the function of diode-connected transistor 755 and the compound PNP transistor 752. In a bipolar integrated circuit, the lateral PNP transistors exhibit a strong Early effect, so that the collector currents are greatly influenced by the collector to base voltage. In order for the current mirror circuits 713 and 717 to have equal output currents when their input currents are equal, the collector voltages on transistors 714 and 718 must be approximately equal. The base to emitter voltage of PNP transistor 753 is about 400 mV as it operates at a very low current, the base current of transistor 754. The voltage drop across diode-connected transistor 755 is about 700 mV, so that the collector voltages of the transistors 714 and 718 are held within about 300 mV of each other. This results in a very much higher effective output impedance for the bidirectional current mirror circuit than could be achieved without the compound transistor 752 and diode 755.

Because the PNP transistors in each of the current mirrors 713 and 717 are not perfectly matched, there may be a small output current offset in the bidirectional current mirror circuit, which may be compensated by adding a small fixed current into or out of terminal 166. Alternatively, the design of the current mirrors may be improved by adding small emitter resistors between the emitters of transistors 715, 716, 719 and 720 and the positive supply voltage, and/or by making all three transistors compound PNP devices similar to 752 by adding three NPN devices to them. These modifications will also increase the effective output impedance. Unfortunately, within the constraints of the semi-custom integrated circuits available, it was not possible to implement these improvements, which, however, would be possible in a full custom IC.

In the semi-custom chip prototype, it was found necessary to use a dual-collector lateral PNP transistor to combine transistors 715 and 716, which results in a slightly worse performance than if all three transistors in the current mirror 713 are identical.

It should be noted that many of the deficiencies of performance of an analog design can be eliminated in a digital signal processor. Thus the charging and discharging of the capacitor 60 is represented in the digital domain by storing a numeric equivalent of the control voltage signal in a register and incrementing or decrementing it with discrete numeric signal increments proportional to a control signal which could be derived from a digital multiplication or other symmetrical nonlinear process on the difference between this signal and the digital directional information signal, thus simulating the theoretical ideal performance of the circuit of FIG. 7, or if desired, of the circuit of FIG. 9 to be described below. This would provide a digital smoothing function that behaves identically to a properly designed servologic circuit. All of the offset voltages and currents, Early effect problems, and imperfect matching of devices and components can be eliminated by digital signal processing, which can be performed to any desired precision.

With reference to FIG. 8, which shows an idealized multiplier characteristic, plotted as a graph of the output current $I_{CS}$ in $\mu$A against the input difference voltage signal $V_{DIFLR}$, the subscripts are omitted for clarity. In the region between −V2 and V2 the curve labeled I exhibits a cubic relationship to the input voltage V. Between V1 and V2, and between −V2 and −V1, the relationship is a square law, and in the regions above V1 and below −V1, the relationship is linear.

The second curve in FIG. 8, labeled G $\mu$S, gives the equivalent conductance value of a hypothetical resistor placed between terminals 56 and 59 in FIG. 6 to simulate the effect of the multiplier circuit. This conductance is simply the current I divided by the voltage V, and therefore it is constant in the outer regions of the graph, falls linearly in the regions between V1 and V2, and between −V1 and −V2, and obeys a square law between −V2 and V2.

The values of V1 and V2 shown in FIG. 8 are 3 V and 1 V respectively, for simplicity, but in practice the multiplier of FIG. 7 has somewhat different break points. If resistors 737 and 738 were replaced by transistors, and the values of $R_y$ and $R_z$ were modified, the multiplier of FIG. 7 could perform very nearly as shown in FIG. 8. However, if the conductance at exactly zero volts input is allowed to be zero, a significant offset voltage can occur at the output of the multiplier for only a small offset current, and therefore it is desirable that the conductance in the central region of the graph should not fall quite to zero, as illustrated by the dotted curve labeled C in this central region. This effect is produced by either installing a fixed resistor of high value between terminals 56 and 59 in FIG. 6, or by adding the current source 756 shown in FIG. 7 to the multiplier circuit. In terms of silicon area, the current source is much smaller than the resistor would be.

In reality, the corners at the transitions between the various regions of FIG. 8 are rounded, and when resistors 737 and 738 of FIG. 7 are used instead of diodes, the transitions at ±V1 are even more rounded and occupy a fairly broad region.

In the servologic circuits described by Fosgate in co-pending patent application Ser. Nos. 07/533,091 and 07/789,530, there is no cube-law region of operation, because the conductance varies linearly between its maximum and minimum values (never falling to zero.) It was found in listening tests that the cube-law region of the servologic multiplier circuit provided for smoother dynamic performance and fewer apparent artifacts than was possible with the pulse width modulation circuits.

By connecting the emitters of transistors 743 and 744 directly together, the Z-input circuit acts like a switch instead of a linear multiplier, so that the square-law region extends down to almost zero voltage. The resistor $R_y$ needs to be about 15 kΩ to mimic the characteristics of the PWM servologic circuit, with break point V1 at about 2.5 V and −V1 at −2.5 V.

As has been mentioned, the servologic circuit behaves like a nonlinear resistor, and so it would seem possible to replace it with a network designed to have conductance characteristics similar to curve G of FIG. 8.

In FIG. 9*a* is shown a simple servologic circuit 49 based on this scheme. The servologic circuit is functionally replaced by a symmetrical nonlinear voltage dependent resistor (VDR) element 57 placed between terminals 56 and 59 which forms a nonlinear time constant with the capacitor 60. Again, the voltage on capacitor 60 is buffered by buffer 62 and inverted by inverter 66 and these components provide the two control voltage outputs $V_{CL}$ and $V_{CR}$ at terminals 64 and 68 respectively.

In principle, the VDR 57 could be implemented by a silicon carbide or other varistor. Such devices, however, usually have rather large voltage drops at the microampere to milliampere currents occurring in the typical servologic circuit, so that a circuit containing active devices must be used.

In FIG. 9*b*, a simple nonlinear two-terminal device 57 is formed by means of an NPN transistor 205 with resistors 203, 204, 206, and 207. When a low voltage is impressed between terminals 56 and 59, resistors 203 and 204 in series yield a total of about 480 kΩ impedance. As the voltage increases to about 1.2 V, transistor 205 begins to conduct, reducing the impedance. At a higher voltage still, the transistor saturates, and resistor 207 in series with resistor 208 is effectively in parallel with the series combination of resistors 203 and 204. Thus the characteristic of this circuit is similar to the desired characteristic for the element 57.

To make this circuit behave similarly for both positive and negative applied voltages, a complementary circuit shown in FIG. 9*c* may be used. When terminal 56 is positive with respect to terminal 59 the NPN transistor 205 can conduct through the diode 208, but diode 210 prevents reverse conduction through PNP transistor 209. Both transistors receive base bias voltage through resistors 203 and 204, and if they have true complementary characteristics, the circuit behaves symmetrically with respect to applied voltages of either polarity. Furthermore, the limiting function has been modified by adding resistor 211 and reducing the values of resistors 203 and 207. This circuit begins to conduct at lower applied voltages, yet retains a limiting impedance of about 30 kΩ.

As PNP transistors on an integrated circuit are extremely unlike the NPN devices, a more satisfactory approach is to use a circuit having only NPN transistors. Such a circuit is shown in FIG. 9*d*. The resistor 203 of FIGS. 9*b* and 9*c* has been split into two resistors 212 and 213, so that a second NPN transistor 214 can be biased similarly to transistor 205 for voltages of opposite polarity. Diode 216 prevents the application of reverse voltage to the collector of transistor 214. Resistors 215 and 217 perform the same function in the lower half of this circuit as do resistors 206 and 207 respectively in the upper half. Resistor 211 performs the same function as in FIG. 9*c*.

A few simple modifications of this circuit are also possible. For example, resistor 213 may be omitted and the bases of transistors 214 and 205 may be connected to the junction of resistors 212 and 204. Alternatively, the base connections may be swapped so that the transistors each conduct at lower applied voltages. The values of the various resistors may be modified to achieve differing characteristics as desired.

The principal drawback to this type of circuit is that with silicon NPN transistors, a fairly large voltage must be across the device before its conductance increases significantly from the bias chain formed by resistors 211–213 and 204 in series. One possible technique for reducing this problem is to make the transistors 205 and 214 into compound stages with preceding lateral PNP devices biased to low currents sufficient only to provide their base currents. However, this circuit has other complications, such as isolating the current sources from producing offset voltages, which make it unsatisfactory.

The nonlinear element 59 may also be used within a servologic circuit like that of FIG. 5 by forcing the current through it into a bidirectional current mirror circuit. The VDR circuit is identified with the current control circuit 102 and the bidirectional current mirror circuit forms the current source 98 of FIG. 5.

Figure 10:
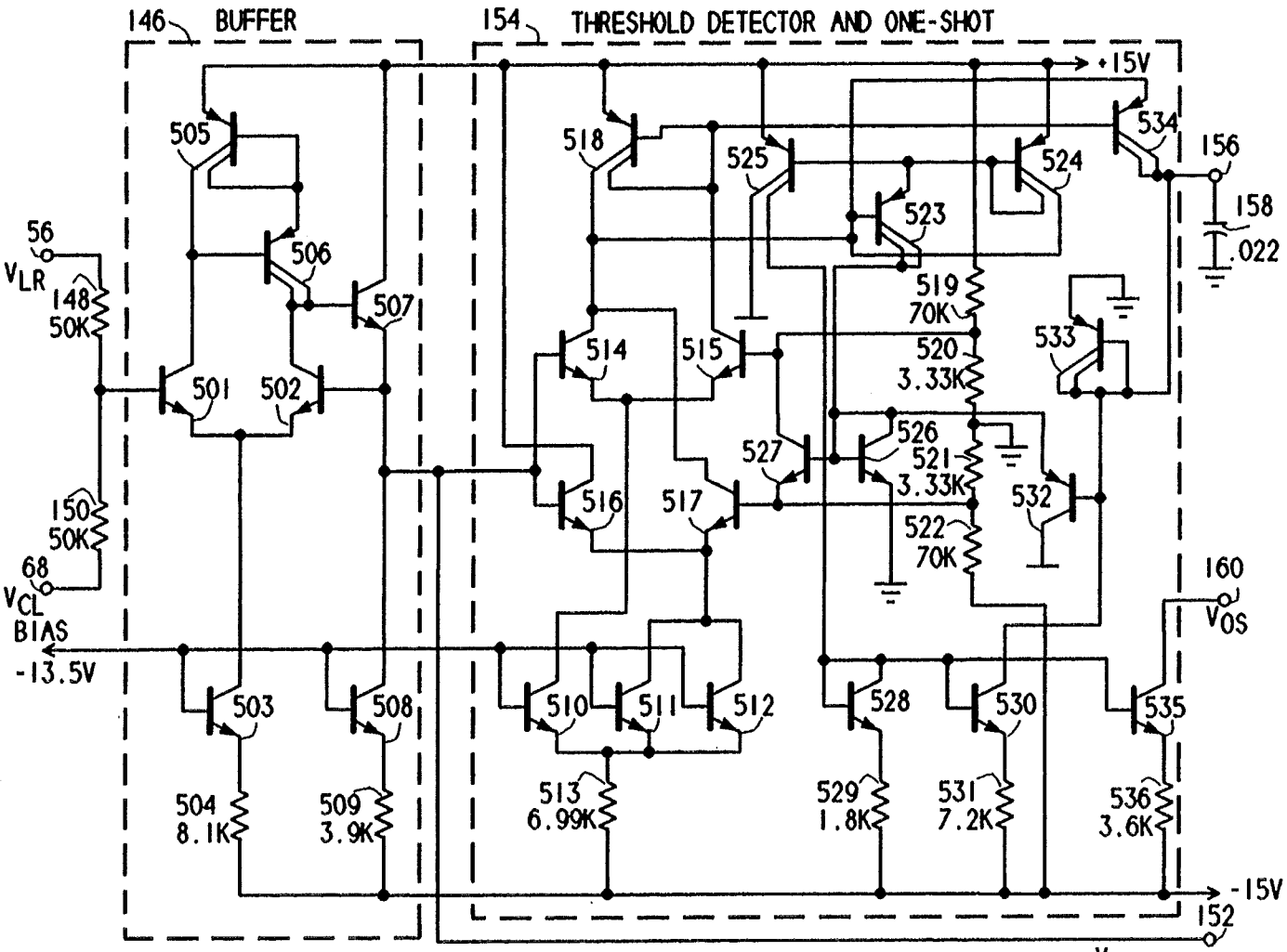
* and FIG. 10 is a detailed schematic of a buffer amplifier and a novel circuit combining the functions of a dual polarity threshold detector and a one-shot, for use in the servologic circuit of FIG. 6.

In FIG. 10 is shown a novel and economical circuit for combining a dual threshold detector with a one-shot. A simple buffer circuit suitable for an integrated design is also shown.

Terminals 56 and 68 receive the input signal $V_{DIFLR}$ and the control voltage signal $V_{CL}$ respectively and apply them to equal resistors 148 and 150 as shown in FIG. 6. The junction of these resistors bears a signal which is the average of these two and is therefore one half of the difference signal between terminals 56 and 59 of FIG. 6. This voltage is applied to the base of transistor 501 which forms a long-tailed pair with transistor 502. The tail current is supplied by transistor 503 and is defined by the bias voltage supply of −13.5 V and the resistor 504.

The collectors of transistors 501 and 502 are connected to a modified Wilson PNP current mirror circuit formed by dual-collector lateral PNP transistors 505 and 506. Ideally, two identical PNP transistors would be used in place of transistor 505, in a circuit like that of current mirror 713 of FIG. 7. However, this circuit saves a PNP transistor, of which there are limited numbers available on a semi-custom chip. The output current appears at the collectors of transistors 506 and 502, and is fed to the base of transistor 507, whose emitter drives the base of transistor 502. The emitter current of transistor 507 is maintained constant by means of the current sink transistor 508, whose current is defined by resistor 509. Any change in the input voltage at the base of transistor 501 is therefore followed by the base of transistor 502 to maintain equal currents in these two transistors (but in practice a small offset occurs due to the base current of transistor 507.)

Thus the circuitry inside dashed outline 146 performs the unity gain buffer function desired according to FIG. 6. The buffered output voltage $V_{DIFLR}$ is applied to the servologic multiplier through terminal 152, and also to the threshold detector and one-shot circuit 154.

In this circuit, matched transistors 510–512 each have equal collector currents, defined by the common emitter resistor 513. The collector of transistor 510 provides a tail current for the long-tailed pair of transistors 514 and 515, while the collectors of transistors 511 and 512 provide double this current for the long-tailed pair formed by transistors 516 and 517. The bases of transistors 514 and 516 are the input of the circuit and are connected to the output of the buffer 146 to receive the difference signal $V_{DIFLR}$. The bases of transistors 515 and 517 are connected to equal positive and negative threshold voltages derived from the positive and negative supply voltages by potential dividers comprising the resistors 519–522. The collector of transistor 515 is connected to the base and one collector of a dual-collector PNP transistor 518 which acts as a current mirror, and whose other collector is connected to the collectors of transistors 514 and 517. The collector of transistor 516 is returned to the positive supply.

When the difference voltage is between the positive and negative threshold voltages, transistors 516 and 515 are on, and transistors 514 and 517 are off. The tail current of transistor 510 passes through transistor 515 and causes transistor 518 to be saturated, while the collector currents of transistors 511 and 512 pass through transistor 516 from the positive supply.

When the difference voltage increases above the positive threshold, transistor 515 begins to be cut off and transistor 514 begins to conduct. At the point where their currents are equal, the current mirror transistor 518 comes out of saturation and allows transistor 523 to conduct.

Similarly, when the difference voltage falls below the negative threshold, transistor 516 begins to shut off and transistor 517 conducts. At the point of equality, half of the tail current passes into the collector circuit of transistor 518, exactly counterbalancing the current supplied through transistor 515, and the current mirror transistor 518 comes out of saturation, driving transistor 523 on.

Transistor 523 drives transistor 524 in a current mirror configuration as described above with reference to transistors 505 and 506, so that the excess current is mirrored at its collector, and drives the bases of transistors 526 and 527. The emitter of diode-connected transistor 526 is grounded, and the base of transistor 527 is driven one diode drop positive, so that its emitter is brought up to ground potential. Its emitter is connected to the negative threshold voltage divider and its collector to the positive threshold voltage divider, so that the negative threshold voltage is forced to just below ground, while the collector current pulls the positive threshold voltage to just above ground potential. Thus both threshold voltages collapse to near zero, and positive feedback occurs causing the threshold detector to switch on almost instantaneously when either threshold is exceeded.

Transistor 525 is connected with its base and emitter in parallel with transistor 524 and therefore drives a collector current equal to half the current in transistor 523 into the bases of transistors 528, 530 and 535. Transistor 528 is diode-connected, and has an emitter resistor 529 of 1.8 K. Transistor 530 has a larger emitter resistor 531, so that its collector current is about a quarter of that in transistor 528. This current is applied via terminal 156 to an external timing capacitor 158, and causes the voltage on this capacitor to fall linearly from the positive supply rail towards ground. A vertical PNP transistor 532 has its base connected to this point, and its emitter to the base of transistor 526.

When the capacitor 158 is fully discharged to ground, transistor 532 pulls the voltage off transistor 526, causing the threshold voltages to start increasing as transistor 527 ceases to conduct. Again, positive feedback occurs in the threshold detector and it turns off rapidly, terminating the drive to transistor 523. As transistor 518 returns to a saturated state, its collector pulls the emitter of transistor 534 to the positive supply voltage, while its base is turned on by the current flowing into the base of transistor 518. The collector of transistor 534 recharges capacitor 158 towards the positive rail. Transistor 534 is turned off when the one-shot pulse is occurring, as its emitter voltage is held negative with respect to its base.

Transistor 533 acts as a catch diode, to prevent the voltage on capacitor 158 from going too far negative and causing Zener breakdown in transistor 526, which can otherwise happen during the switching transitions of the one-shot.

Transistor 535, with emitter resistor 536, provides an output current pulse to the terminal 160, which turns on the transistor 750 of FIG. 7, as has been described. The voltage $V_{OS}$ is developed at this terminal.

Thus, the one-shot function is provided in combination with a dual-polarity threshold detector with hysteresis to provide a snap action switching on voltages exceeding either threshold. If the input voltage is itself changing during the one-shot pulse, the pulse will be terminated sooner if the input goes through zero voltage and reverses its sign. This has been found to have no deleterious effects on the surround processor's performance. Furthermore, if the input voltage remains higher than the thresholds, the one-shot will remain turned on until this condition ceases to exist.

The duration of the one-shot pulse is determined by the external capacitor value and the discharging current, which is defined by the circuit values. Therefore, longer or shorter pulses can be obtained by changing the value of capacitor 158.

These and other modifications of this circuit and the other circuitry described herein will be apparent to those skilled in the art, and may be made without departing from the spirit of the invention.

What is claimed is:

1. An audio signal processor for multichannel redistribution of stereophonic sound on a plurality of loudspeakers surrounding the listener comprising an input conditioning and matrixing means, a variable matrixing means and a control voltage generator means for producing a plurality of control voltages from the output signals of said input conditioning and matrixing means and for controlling the variable parameters of said variable matrixing means, said control voltage generator means comprising:

at least one pair of input terminals for receiving from said input conditioning and matrixing means a pair of partially correlated audio signals containing directional information;

at least one directional detector means for comparing each said pair of correlated audio signals to produce a corresponding directional information signal; and at least one variable time constant smoothing means for smoothing each of said directional information signals to produce a corresponding control voltage signal, each said smoothing means being responsive to the difference between its input said directional information signal and the corresponding output said control voltage signal, each said variable time constant smoothing means comprising:

a controlled current source means having a control terminal and an output;

a capacitor means connected to the output of said controlled current source means and ground;

a differencing means for producing a difference signal corresponding to the difference between the input said directional information signal and the output said control voltage signal; and a current control means for providing a current source control signal to the control terminal of said controlled current source means for varying the current provided by said controlled current source means to said capacitor means;

said control voltage signal being developed across said capacitor means.

2. Apparatus according to claim 1 further comprising at least one buffer means for buffering each said control voltage signal and providing it to said variable matrixing means.

3. Apparatus according to claim 2 further comprising at least one inverter means for inverting the polarity of each said buffered control voltage signal to provide therefrom a second control voltage signal of opposite polarity for application to said variable matrixing means.

4. Apparatus according to claim 3 wherein each said differencing means comprises:

a first resistor means connected to the output of one of said directional detector means for receiving one of said directional information signals;

a second resistor means of equal resistance to said first resistor means connected to the output of the corresponding one of said inverter means for receiving said second corresponding control voltage signal;

said first and second resistors being connected to a common junction; and a buffer means having an input connected to said common junction, the output voltage thereof being proportional to the average of the signals applied to the two resistors, and therefore to the difference between said one of said directional information signals and the corresponding control voltage signal thereto.

5. Apparatus according to claim 1 further comprising:

at least one threshold detector means responsive to each said difference signal for detecting whether said difference signal exceeds either a positive or a negative threshold value; and at least one one-shot means triggered by one or more of said threshold detector means for producing a pulse signal of constant duration whenever said difference signal exceeds either threshold value;

said pulse signal being applied to each said current control means for causing the output current of the corresponding one of said controlled current source means to be proportional to its said difference signal for the duration of said pulse signal from said one-shot means, thereby to attain a minimum equivalent smoothing time constant with each said smoothing capacitor means for all said directional information signals.

6. Apparatus according to claim 1 wherein said current control means comprises a multiplier circuit and said controlled current source means comprise a differencing bidirectional current mirror circuit.

7. The apparatus of claim 6 wherein said multiplier circuit comprises:

a common input terminal;

first and second multiplier output terminals;

first, second and third differential current sink means each having an input and two outputs, and whose inputs are connected to said common input terminal, said outputs sinking currents which are equal when the input voltage is zero and vary linearly in opposite directions with the input voltage up to a maximum current and down to zero current;

first and second equal resistor means connected between the outputs of said first differential current sink means and a first positive voltage lower than the positive supply voltage;

first multiplier cell means having two inputs, two control inputs and two outputs, the inputs connected to the outputs of said second differential current sink means, the control inputs connected to said first and second equal resistor means and the outputs of said first differential current sink means for setting its multiplication coefficient to a positive or negative value less than or equal to unity;

first and second matched forward biased diode means whose cathodes are connected to the outputs of said first multiplier cell means and whose anodes are connected to a second positive voltage higher than said first positive voltage but lower than the positive supply voltage; and second multiplier cell means having two inputs, two control inputs and two outputs, the inputs connected to the outputs of said third differential current sink means, the control inputs connected to said first and second matched diode means and the outputs of said first multiplier cell means for setting its multiplication coefficient to a positive value less than or equal to unity, the outputs of said second multiplier cell means being connected to said first and second output terminals.

8. The apparatus of claim 7 wherein said first and second positive voltages are obtained by first and second dropping resistors connected from the positive supply voltage to the junction of said first and second diode means, and from this junction to the junction of said first and second resistor means, respectively.

9. The apparatus of claim 7 further comprising means for reducing the voltage across said first diode means in response to a pulse signal, for applying to the control inputs of said second multiplier cell a voltage for setting its multiplication coefficient to unity for the duration of said pulse signal.

10. The apparatus of claim 9 wherein said means for reducing the voltage across said first diode means is an NPN transistor whose base is connected to one collector of a dual collector PNP transistor, the collector of said NPN transistor is connected to said second positive voltage, and the emitter is connected to the cathode of said first diode means, the emitter of said PNP transistor being connected to the positive supply voltage, the base and the other collector of the PNP transistor being connected to receive said pulse signal.

11. The apparatus of claim 7 further comprising a current sink means for increasing the current flowing through said second diode means for applying to the inputs of said second multiplier cell a voltage sufficient to prevent its multiplication coefficient from falling to zero.

12. The apparatus of claim 7 wherein said first differential current sink has a high sensitivity and acts like a voltage-controlled switch, the output currents thereof being switched between the said maximum current and zero over a very small range of the input voltage applied to said common input terminal.

13. The apparatus of claim 7 wherein said first and second resistor means are replaced by third and fourth matched forward biased diode means.

14. The apparatus of claim 7 wherein each of said differential current sink means comprises:

first and second matched NPN transistors, their bases being connected to the input and ground respectively;

first and second equal current sinks connected from the emitters of said first and second transistors to a negative supply voltage; and a scale resistor connected between the emitters of said first and second transistors;

the collectors of said first and second transistors being the outputs of said differential current sink means, and wherein each of said first and second multiplier cells comprises:

first, second, third and fourth matched NPN transistors;

the emitters of said first and second transistors being connected together to one said input, and the emitters of said third and fourth transistors being connected together to the other said input;

the bases of said first and fourth transistors being connected together to one said control input, and the bases of said second and third transistors being connected to the other said control input;

the collectors of said first and third transistors being connected to one said output, and the collectors of said second and fourth transistors being connected to the other said output.

15. The apparatus of claim 14 wherein the scale resistors of said first and second differential current sinks have values which cause the currents therein to vary between zero and the maximum values thereof over a range of input voltages applied to said common input terminal which is less than the maximum range of input voltages that can be applied thereto, and the scale resistor of said third differential current sink is such that the currents therein vary between zero and their maximum value over the maximum range of input voltage that can be applied to said common input terminal;

thereby ensuring that the output differential current of said multiplier circuit varies with a cubic relationship to the input voltage over a range thereof less than a first magnitude, a square-law relationship to the input voltage when its magnitude is between said first magnitude and a second magnitude, and a linear relationship to the input voltage when its magnitude is between said second magnitude and the maximum magnitude that can be applied to said common input terminal.

16. The apparatus of claim 14 wherein the scale resistor of said first differential current sink is made zero to reduce said first magnitude to zero.

17. The apparatus of claim 6 wherein said differencing bidirectional current mirror circuit comprises:

first and second current mirror circuits, each having an input and an output terminal, and a common terminal connected to the positive supply voltage;

third current mirror circuit of opposite polarity having an input and an output terminal, and a common terminal connected to the negative supply voltage;

the inputs of said first and second current mirror circuits being connected to the outputs of said multiplier circuit;

the output of said first current mirror circuit being connected to the input of said third current mirror circuit; and the outputs of said second and third current mirror circuits being connected to a common output terminal, which is the output of said controlled current source.

18. The apparatus of claim 17 wherein said current mirrors each comprise three transistors of identical characteristics, said first and second current mirror circuits comprising lateral PNP transistors and said third current mirror comprising NPN transistors;

the first and second transistors thereof having their emitters connected to said common terminal and their bases connected to the emitter of the third transistor thereof;

the collector of the second transistor being connected to the emitter of the third transistor;

the collector of the first transistor and the base of the third transistor being connected to the input terminal; and the collector of the third transistor being connected to the output terminal thereof;

the circuit being operative to provide an output current substantially equal to the input current by compensating for the finite current gain of each of the three transistors.

19. The apparatus of claim 17 further comprising:

a compound PNP transistor in common base connection, the output of said first current mirror circuit being connected to the emitter thereof instead of to the input of said third current mirror circuit, the collector thereof being instead connected to the input of said third current mirror circuit; and a diode-connected transistor, the output of said second current mirror circuit being connected to the anode thereof instead of to said common output terminal, the cathode of said diode-connected transistor being connected instead to said common output terminal, and also being connected to the base of said compound PNP transistor;

the function of these components being to force both of said outputs of said first and second current mirror circuits to be always at nearly the same potential, thereby to cancel out the error currents due to Early effect in the lateral PNP transistors contained therein and increase the output impedance of the said bidirectional current mirror circuit.

20. Apparatus according to claim 4 wherein said buffer means of said differencing means comprises:

first current sink means;

first and second matched NPN transistors, their emitters connected together to said first current sink means, the base of said first transistor being connected to the junction of said first and second resistor means;

active load means comprising first and second dual collector lateral PNP transistors, the emitter of said first PNP transistor being connected to the positive supply, the base and one collector thereof being connected to the emitter of said second PNP transistor, the other collector thereof and the base of said second PNP transistor being connected to the collector of said first NPN transistor, and the collectors of said second PNP transistor being connected to the collector of said second NPN transistor;

second current sink means;

third NPN transistor, the base thereof connected to the collectors of said second PNP and second NPN transistors, the emitter thereof to the base of said second NPN transistor, to said second current sink means, and to the output terminal of said buffer means, and the collector thereof to the positive supply voltage;

said first and second current sinks each comprising an NPN transistor and a resistor, the base of said transistor being connected to a bias supply voltage and the emitter thereof being returned to the negative supply voltage through said resistor for defining the collector current thereof, the collectors of said transistors of said first and second current sinks being connected respectively to the junction of the emitters of said first and second NPN transistors and to the emitter of said third NPN transistor.

21. The apparatus of claim 5 wherein said threshold detector means and one-shot means comprise:

first and second current sinks, said second current sink drawing twice the current in said first current sink;

first and second voltage dividers connected respectively from positive and negative supply voltages to ground for providing equal positive and negative threshold voltages;

first and second matched NPN transistors, their emitters connected together to said first current sink, their bases to the output of said differencing means and to said positive threshold voltage respectively;

third and fourth matched NPN transistors, their emitters connected together to said second current sink, their bases to the output of said differencing means and to said negative threshold voltage respectively, the collector of said third NPN transistor being connected to the positive supply voltage;

first PNP current mirror having an input, an output providing an equal current to the input current, and a common terminal connected to the positive supply, its input is connected to the collector of said second NPN transistor and its output to the collectors of said first and fourth NPN transistors;

second PNP current mirror having an input, a common terminal connected to the positive supply voltage, and first and second outputs, whose input is connected to the output of said first current mirror;

fifth diode-connected NPN transistor, whose emitter is grounded and collector and base are connected together to said first output of said second PNP current mirror;

sixth NPN transistor whose base is connected to the base and collector of said fifth transistor, its emitter to said negative threshold voltage, and its collector to said positive threshold voltage, for causing both voltages to be switched to approximately ground potential whenever the threshold detector means produces an output signal, thereby causing positive feedback to make the threshold detector switch rapidly;

third NPN current mirror having an input and first and second outputs and a common terminal connected to the negative supply voltage, said input being connected to said second output of said second current mirror;

a timing terminal connected to the first output of said third NPN current mirror;

a timing capacitor means connected from said timing terminal to ground;

second dual collector lateral PNP transistor, whose emitter is connected to the output of said first PNP current mirror, its base to the input thereof, and its collector to said timing terminal for providing a charging current to said timing terminal for charging said timing capacitor means to the positive supply voltage whenever the difference signal is between the said positive and negative threshold voltages;

said capacitor being discharged linearly from the positive supply voltage to ground by said third PNP current mirror when said difference signal exceeds either of said positive and negative threshold voltages, said discharge occurring in a constant time during which said threshold detector remains switched on, providing an output pulse signal of fixed duration;

a first vertical PNP transistor whose collector is connected to the negative supply voltage, its base to said timing terminal, and its emitter to the bases of said fifth and sixth NPN transistors, for turning them off when the voltage on said timing capacitor falls to or below ground potential and terminating said output pulse signal;

a catch diode whose anode is grounded and whose cathode is connected to said timing terminal, for preventing the voltage thereon from falling significantly below ground potential;

said second output of said third current mirror providing said pulse signal to the output terminal of said threshold detector means and one-shot means.

22. The apparatus of claim 21 wherein said first and second current sinks comprise respectively one and two matched NPN transistors whose bases are returned to a bias voltage, whose emitters are connected together through a single resistor to the negative supply voltage for determining the currents in each transistor;

and wherein said first PNP current mirror comprises a dual collector lateral PNP transistor, its base and one collector being the input terminal, its emitter being the common terminals and its other collector being the output terminal thereof;

and wherein said second PNP current mirror comprises first, second and third dual collector lateral PNP transistors, the input terminal being connected to the base of said third PNP transistor and one collector of said second PNP transistor, the common terminal to the emitters of said first and second PNP transistors, the first output terminal to both collectors of said third PNP transistor, and the second output to one collector of said first PNP transistor, the other collector thereof being returned to the negative supply voltage;

and wherein said third NPN current mirror comprises a first diode connected NPN transistor, its collector and base connected to the input, its emitter through a first resistor to the negative supply voltage, a second NPN transistor whose base is connected to the input, its emitter through a second resistor to the negative supply voltage and its collector to the first output, and a third NPN transistor whose base is connected to the input, its emitter through a third resistor to the negative supply voltage, and its collector to the second output, said first, second and third resistors determining the ratios of the first and second output currents to the input current.

23. An audio signal processor for multichannel redistribution of stereophonic sound on a plurality of loudspeakers surrounding the listener comprising an input conditioning and matrixing means, a variable matrixing means and a control voltage generator means for producing a plurality of control voltages from the output signals of said input conditioning and matrixing means and for controlling the variable parameters of said variable matrixing means, said control voltage generator means comprising:

at least one pair of input terminals for receiving from said input conditioning and matrixing means a pair of partially correlated audio signals containing directional information;

at least one directional detector means for comparing each said pair of correlated audio signals to produce a corresponding directional information signal; and at least one variable time constant smoothing means for smoothing each of said directional information signals to produce a corresponding control voltage signal, each said smoothing means being responsive to the difference between its input said directional information signal and the corresponding output said control voltage signal, each said variable time constant smoothing means comprising:

a symmetrical nonlinear resistor means connected to the said directional information signal;

a capacitor means connected to the other terminal of said resistor means and to ground;

said control voltage signal being developed across said capacitor means.

24. The apparatus of claim 23 further comprising at least one buffer means for buffering each said control voltage signal for application to said variable matrixing means.

25. The apparatus of claim 24 further comprising at least one inverter means for providing from each said control voltage signal a second control voltage signal of opposite polarity to said control voltage signal, for application to said variable matrixing means.

26. The apparatus of claim 23 wherein each said symmetrical nonlinear resistor means comprises a varistor.

27. The apparatus of claim 23 wherein each said symmetrical nonlinear resistor means comprises:

first and second terminals;

first and second resistors in series between a junction point and said second terminal;

first NPN and second complementary PNP transistors whose bases are connected to the junction of said first and second resistors;

third resistor connected to the emitters of said first and second transistors and to said second terminal;

first diode whose cathode is connected to the collector of said first NPN transistor;

second diode whose anode is connected to the collector of said second PNP transistor; and fourth resistor connected from said junction point to the anode of said first diode and the cathode of said second diode.

fifth resistor connected from said first terminal to said junction point.

28. The apparatus of claim 27 wherein said fifth resistor is omitted and said first terminal is connected directly to said junction point.

29. The apparatus of claim 23 wherein each said symmetrical nonlinear resistor means comprises:

first and second terminals;

first, second and third resistors in series between a junction point and said second terminal, said first and third resistors being of equal values;

first matched NPN transistor whose base is connected to the junction of said second and third resistors;

second matched NPN transistor whose base is connected to the junction of said first and second resistors;

fourth resistor connected from the emitter of said first NPN transistor to said second terminal;

fifth resistor of equal value to said fourth resistor connected from the emitter of said second NPN transistor to said junction point;

first matched diode whose cathode is connected to the collector of said first NPN transistor;

second matched diode whose cathode is connected to the collector of said second NPN transistor; and sixth resistor connected from said junction point to the anode of said first diode;

seventh resistor of equal value to said sixth resistor connected from said second terminal to the anode of said second diode; and eighth resistor connected from said first terminal to said junction point.

30. The apparatus of claim 29 wherein said second resistor is omitted and the bases of both NPN transistors are connected to the junction of said first and third resistors.

31. The apparatus of claim 29 wherein the base of said first NPN transistor is alternatively connected to the junction of said first and second resistors and the base of said second NPN transistor is connected to the junction of said second and third resistors.

32. The apparatus of claim 29 wherein said eighth resistor is omitted and said first terminal is connected directly to said junction point.

33. A method for smoothing an input signal to produce a smoothed signal with a variable time constant responsive to the difference between said input signal and the smoothed signal, comprising:

generating a difference signal proportional to the difference between said input signal and [the]said smoothed signal;

causing said difference signal to control a voltage dependent variable current source of high output impedance; and applying the output current of said variable current source to charge and discharge a capacitor, in the direction required for the voltage thereon to change towards the value of said input signal, said smoothed signal being the voltage across said capacitor.

34. The method of claim 33 wherein the output current of said voltage dependent variable current source is proportional to the cube of the said difference signal when said difference signal is smaller in magnitude than a first magnitude; and proportional to the square of the said difference signal when the magnitude of said difference signal is larger than said first magnitude but smaller than a second magnitude; and proportional to said difference signal when its magnitude exceeds said second magnitude.

35. The method of claim 34 wherein the output current of said voltage dependent variable current source is linearly proportional to said difference signal when the magnitude thereof is below said first magnitude, instead of to the cube thereof.

36. The method of claim 34 wherein said first magnitude is zero.

37. The method of claim 33 wherein the output current of said voltage dependent variable current source has a maximum magnitude and is increased suddenly to its maximum magnitude for a short, but non-zero predetermined period of time whenever the magnitude of said difference signal exceeds a specified threshold value that is less than the maximum possible magnitude of said difference signal.

38. A method for smoothing an input signal to produce a smoothed signal with a variable time constant responsive to the difference between said input signal and said smoothed signal, comprising:

generating a difference signal proportional to the difference between said input signal and said smoothed signal;

causing said difference signal to control a voltage dependent variable current source of high output impedance providing a current which is nonlinearly dependent upon said difference signal; and applying the said current to charge and discharge a capacitor so that the voltage thereon changes in a direction towards the instantaneous voltage of the input signal;

said voltage on said capacitor being said smoothed signal.

39. The method of claim 38 wherein said current is derived by application of a signal proportional to said difference between said original signal and said smoothed signal to a symmetrical nonlinear resistive element.

40. The method of claim 38 wherein said symmetrical nonlinear resistive element is a combination of passive and active components designed to provide a specific nonlinear relationship between the voltage impressed thereon and the current through said element.

41. The method of claim 38 wherein the output current of said current source is increased to its maximum magnitude for a short, predetermined period of time whenever the magnitude of said difference signals exceeds a specified threshold value.

42. A method for smoothing a digital input signal to produce a digital smoothed signal in real time with a variable time constant responsive to the difference between said digital input signal and said digital smoothed signal, comprising:

storing the successive values of said digital smoothed signal in a digital storage register means;

evaluating the digital difference signal between successive values of said digital input signal and concurrent successive values of said digital smoothed signal in real time;

deriving therefrom in real time a digital control signal symmetrically and approximately piecewise polynomially nonlinearly related to said digital difference signal; and incrementing or decrementing the value of said digital smoothed signal in real time at a rate proportional to the successive values of said digital control signal in the direction towards the current value of said digital input signal.

43. The method of claim 42 wherein said digital control signal is proportional to the cube of said digital difference signal when the absolute magnitude thereof is below a first magnitude, and is proportional to the square thereof when the absolute magnitude thereof is greater than said first magnitude, and less than a second magnitude, and is linearly proportional thereto when the absolute magnitude thereof exceeds said second magnitude.

44. The method of claim 43 wherein said digital control signal is linearly proportional to said digital difference signal below said first magnitude, instead of to the cube thereof.

45. The method of claim 43 wherein said first magnitude is zero.

46. The method of claim 42 wherein the magnitude of said digital control signal is increased to a maximum value for a predetermined short non-zero period of time when the magnitude of said digital difference signal first increases beyond a predetermined threshold value less than the maximum possible magnitude of said digital difference signal.

47. A method for smoothing an analog input signal to produce a smoothed signal with a signal voltage dependent variable time constant responsive to the difference between said input signal and said smoothed signal, comprising:

deriving a current which is symmetrically nonlinearly resistively dependent upon the difference between said input signal and said smoothed signal, said nonlinear resistive dependency being approximately piecewise polynomial in form, having at least a second degree dependency below a threshold value of said difference and linear dependency above said threshold value; and applying the said current to charge and discharge a capacitor so that the voltage thereon changes in a direction towards the instantaneous voltage of the input signal;

said voltage on said capacitor being said smoothed signal.

48. The method of claim 47 wherein said current is derived by application of a signal proportional to said difference between said original signal and said smoothed signal to a symmetrical nonlinear resistive element.

49. The method of claim 47 wherein said symmetrical nonlinear resistive dependency is produced by a combination of passive and active components designed to provide a specific nonlinear relationship between the voltage impressed thereon and the current through said element, said nonlinear relationship being approximately a polynomial of at least second degree for voltages less in magnitude than a threshold value, and linear for voltages exceeding in magnitude said threshold value.

50. The method of claim 49 wherein said symmetrical nonlinear resistive element comprises:

first NPN transistor and second complementary PNP transistor having their bases connected together and their and emitters connected together;

first diode having its cathode connected to the collector of said first NPN transistor;

second identical diode having its anode connected to the collector of said second PNP transistor;

first resistor connected to the emitters of said first and second transistors and to said capacitor;

second resistor connected in common to the anode of said first diode and the cathode of said second diode;

third resistor connected from said input signal to said second resistor;

fourth resistor connected from the junction of said second and third resistors to the bases of said first and second transistors; and fifth resistor connected from the bases of said first and second transistors to said capacitor;

said network being operative to provide an equivalent resistance equal to the sum of said third, fourth and fifth resistors when the voltage across said network is insufficient to cause either said first or second transistor to conduct, and to provide an equivalent resistance approximately equal to the sum of said first, second and third resistors when the voltage across said network is sufficient to saturate either said first or said second transistor, and to provide intermediate values of equivalent resistance when the voltage across said network is sufficient to cause either said first or second transistor to conduct without being saturated.

51. The method of claim 49 wherein said symmetrical nonlinear resistive element comprises:

first NPN transistor;

first resistor connected from the base said first transistor to said capacitor;

second identical NPN transistor;

second resistor of equal value to said first resistor connected from the base of said second transistor to a common junction point;

third resistor connected between the bases of said first and second transistors;

first diode having its cathode connected to the collector of said first NPN transistor;

fourth resistor connected from the anode of said first diode to said common junction point;

second identical diode having its cathode connected to the collector of said second NPN transistor;

fifth resistor equal to said fourth resistor connected from the anode of said second diode to said capacitor;

sixth resistor connected from the emitter of said first transistor to said capacitor;

seventh resistor equal to said sixth resistor connected from the emitter of said second resistor to said common junction point; and eighth resistor connected from the input signal to said common junction point;

said network being operative to provide an equivalent resistance equal to the sum of said first, second, third and eighth resistors when the voltage cross the network is insufficient to cause either said first or second transistor to conduct, and to provide an equivalent resistance approximately equal to the sum of said first, fourth and sixth resistors whenever the voltage across said network is sufficient to saturate either said first or said second transistor, and to provide intermediate values of equivalent resistance when the voltage across said network is sufficient to cause either said first or second transistor to conduct without being saturated.

52. The method of claim 47 wherein said current has a maximum magnitude and is increased to its maximum magnitude for a short but non-zero predetermined period of time whenever the magnitude of said difference between said input signal and said smoothed signal exceeds a specified threshold value that is less than the maximum possible magnitude of said difference between said input signal and said smoothed signal.

* * * * *

UNITED STATES PATENT AND TRADEMARK OFFICE

CERTIFICATE OF CORRECTION

PATENT NO. : 5,428,687

DATED : June 27, 1995

INVENTOR(S) : Martin E.G. Willcocks et al.

It is certified that error appears in the above-indentified patent and that said Letters Patent is hereby corrected as shown below:

Col. 11, line 46, "ICS" should read --$I_{CS}$--.

Col. 17, line 23, equation 11, "tan h" should read --tanh--.

Col. 18, line 4, equation 23, "tan $h^{-1}$" should read --$\tanh^{-1}$--.

Signed and Sealed this

Thirteenth Day of February, 1996

Bruce Lehman

*Attest:*

BRUCE LEHMAN

*Attesting Officer*

*Commissioner of Patents and Trademarks*